US012766386B2

(12) United States Patent
Martell et al.

(10) Patent No.: US 12,766,386 B2
(45) **Date of Patent: *Oct. 20, 2026**

(54) REMOVABLE SNAP-IN STRAP SYSTEM

(71) Applicant: KARSTEN MANUFACTURING CORPORATION, Phoenix, AZ (US)

(72) Inventors: James D. Martell, Phoenix, AZ (US); Jason S. Milligan, Phoenix, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 107 days.

This patent is subject to a terminal disclaimer.

(21) Appl. No.: 18/599,041

(22) Filed: Mar. 7, 2024

(65) Prior Publication Data

US 2024/0207703 A1 Jun. 27, 2024

Related U.S. Application Data

(63) Continuation of application No. 17/540,210, filed on Dec. 1, 2021, now Pat. No. 11,925,842.

(60) Provisional application No. 63/120,070, filed on Dec. 1, 2020.

(51) Int. Cl.

| | |
|---|---|
| ***A63B 55/00*** | (2015.01) |
| ***A45F 3/14*** | (2006.01) |
| ***A63B 55/40*** | (2015.01) |

(52) U.S. Cl.

CPC ..... *A63B 55/408* (2015.10); *A45F 3/14* (2013.01); *A63B 55/40* (2015.10); *A45F 2003/142* (2013.01)

(58) Field of Classification Search

CPC ..... A63B 55/0408; A63B 55/40; A45F 3/14; A45F 2003/142

See application file for complete search history.

(56) References Cited

U.S. PATENT DOCUMENTS

| | | | |
|---|---|---|---|
| 5,038,984 | A | 8/1991 | Izzo |
| 5,221,030 | A | 6/1993 | Cretinon |
| 5,269,449 | A | 12/1993 | Sattler |
| 6,006,974 | A | 12/1999 | Varney |
| 6,102,202 | A | 8/2000 | Jones |
| 6,305,535 | B1 | 10/2001 | Fair |
| 6,422,444 | B1 | 7/2002 | Richardson |
| 6,672,600 | B2 | 1/2004 | Engelhardt |

(Continued)

FOREIGN PATENT DOCUMENTS

| | | |
|---|---|---|
| JP | A2023553388 | 12/2023 |
| WO | 2022119987 A1 | 6/2022 |

OTHER PUBLICATIONS

PCT International Search Report and Written Opinion dated May 11, 2016 from corresponding PCT Application No. PCT/US16/020333, Filed Mar. 2, 2016.

*Primary Examiner* — Tri M Mai

(57) ABSTRACT

A golf bag with a removable snap-in strap system wherein the strap system comprises a set of heterogeneous connectors that fasten a set straps to the golf bag. The connectors are able to accommodate the dominant hand of the user through a variety of heterogeneous configurations of the connectors, including geometry, ability to angle the straps, and surface area. These configurations allow the straps to create more arm space for the user, an easier assembly to a corresponding divider top, and equal distribution of weight across the straps, thereby, promoting comfort and balance for the user.

16 Claims, 14 Drawing Sheets

(56) References Cited

U.S. PATENT DOCUMENTS

| | | | | |
|---|---|---|---|---|
| 7,025,237 | B2 | 4/2006 | Herold | |
| 7,124,887 | B2 | 10/2006 | Reimers | |
| 7,131,534 | B2 | 11/2006 | Enes | |
| 7,150,082 | B2 * | 12/2006 | Beletsky | A44B 11/266 24/625 |
| 8,657,168 | B2 | 2/2014 | Wear | |
| 9,661,911 | B2 | 5/2017 | Wu | |
| 10,245,486 | B2 | 4/2019 | Burgess | |
| 10,610,002 | B2 | 4/2020 | Pacha | |
| 10,912,361 | B2 | 2/2021 | Wu | |
| 11,925,842 | B2 * | 3/2024 | Martell | A63B 55/408 |
| 2001/0003344 | A1 | 6/2001 | Jarman | |
| 2003/0075464 | A1 | 4/2003 | Shin | |
| 2004/0238385 | A1 | 12/2004 | Herold | |
| 2008/0164165 | A1 * | 7/2008 | McGuire | A63B 55/408 206/315.3 |
| 2016/0183637 | A1 * | 6/2016 | Kung | A44B 11/266 24/625 |
| 2017/0014693 | A1 | 1/2017 | Armstrong | |
| 2021/0059386 | A1 * | 3/2021 | Burgess | A63B 55/408 |

* cited by examiner

REMOVABLE SNAP-IN STRAP SYSTEM

RELATED APPLICATIONS

This is a continuing application from U.S. patent application Ser. No. 17/540,210, filed Dec. 1, 2021, now U.S. Pat. No. 11,925,842, which claims the benefit of U.S. Provisional Patent Appl. No. 63/120,070, filed on Dec. 1, 2020, which is fully incorporated herein by reference.

TECHNICAL FIELD

This disclosure relates generally to golf club bags, and relates more particularly to golf club bags having a removable strap system.

BACKGROUND

Current carry golf bag straps are fastened to a wall of the golf bag through slits. In current strap systems, the straps are typically sewn over into a "T" shape and fed through the slits. The "T" shape prevents the strap from sliding out of the slit. Straps occasionally need to be removed or replaced by the consumer due to wear/failure, comfort, or aesthetic preference. In order to remove the straps of the current design, the consumer needs to access the interior side of the wall comprising the slit. In some design, this can require removing fabric or other materials inside the bag, and/or maneuvering through difficult-to-reach spaces. There is a need in the art for a carry golf bag with easily replaceable straps without damaging the bag body.

BRIEF DESCRIPTION OF THE DRAWINGS

To facilitate further description of the embodiments, the following drawings are provided in which.

Figure 1:
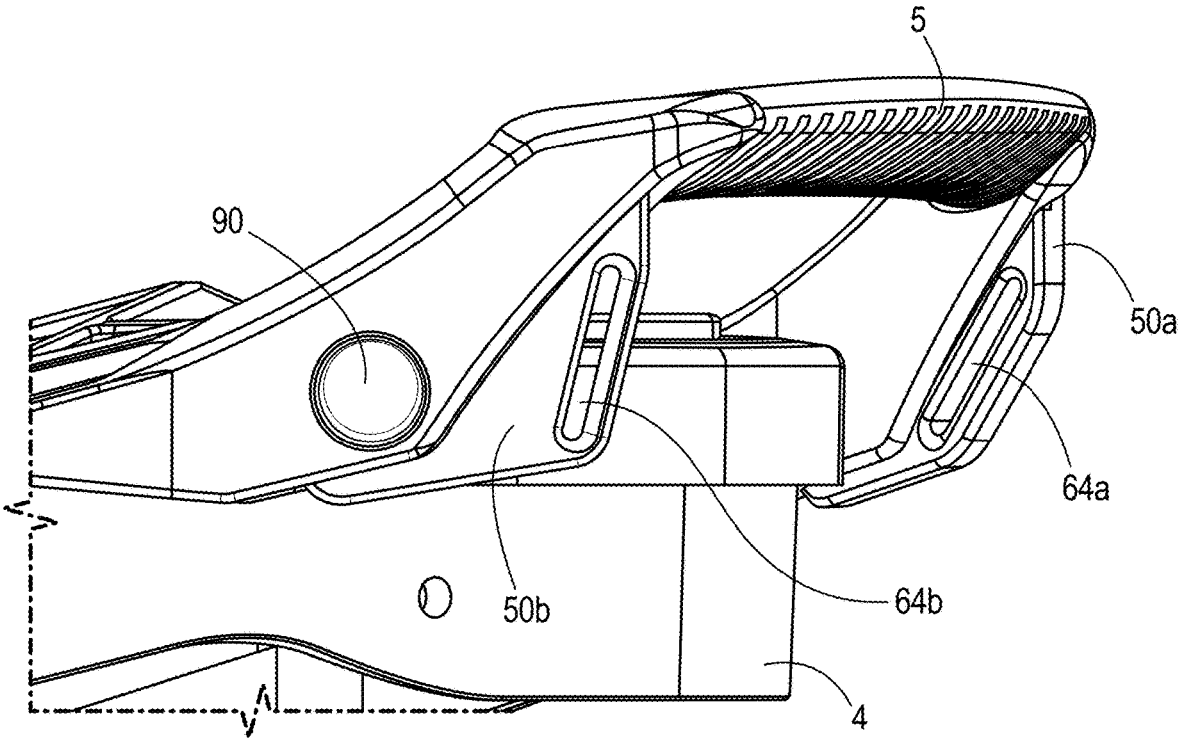
FIG. 1 illustrates a perspective view of installed first and second connectors in a golf bag, according to a first embodiment.

The golf bag described herein comprises a strap system. The strap system comprises a first connector and a second connector. The first and second connector can comprise heterogeneous geometry in order to accommodate a left-hand dominant or right-hand dominant user and promote comfort. The connectors herein can connect with a divider top of the golf bag at an angle that allows the straps to extend straight from the bag to the user. The heterogeneous geometry of the connectors as well as the angle at which the straps extend from the connectors with relation to the golf bag create a strap system that is both comfortable and adaptable to the dominant hand of the user.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

DEFINITIONS

The term "golf bag," as used herein, refers to a storage container for transporting golf clubs. The golf bag can comprise at least a flat, a top, a stand assembly, and a base.

The term "golf bag top," as used herein, refers to the portion of the golf bag that comprises a divider top and a handle.

The term "carry bag," as used herein, refers to a type of golf bag that is designed to be carried throughout a golf round. Carry bags can comprise a stand assembly and a strap system, defined below.

The term "flat," as used herein, refers to a fabric outer, shell, or skin that is configured to form a body of the golf bag. The flat can comprise a crush zone.

The term "base" as used herein, refers to a rigid or semi-rigid structural component that forms an enclosed bottom of the golf bag.

The term "divider top," as used herein, refers to a rigid or semi-rigid structural component that forms a top and a mouth of the golf bag.

The term "stand assembly" as used herein, refers to a deployable apparatus for supporting the golf bag. The stand assembly can comprise one or more legs, a spring, and spring attachment joints.

The term "handle," as used herein, refers to a component that can be grasped and used to lift the golf bag. The handle can be attached to the divider top.

The term "straps," as used herein, refers to fabric or mesh components that allow a golfer to lift and carry the golf bag. The straps can be configured to be placed over a golfer's shoulder or shoulders in a single- or double-shoulder configuration.

The term "strap system," as used herein, refers to a collection of straps that attach to the golf bag and the straps' attachment mechanisms.

The term "upright" as used herein, refers to a position of the golf bag where the majority of the golf bag is sitting vertically above the base, and the stand assembly of the golf bag is retracted.

The term "deployed" as used herein, refers to a position of the golf bag wherein the bag is angled and supported by the stand assembly.

The term "engaged" as used herein, refers to a position of the strap system wherein the straps are straightened as if being used to carry a golf bag.

The term "harbors," as used herein, refers to slots that receive the attachment mechanisms of the strap system. The harbor can be located in the divider top or the handle.

The term "balance point" as used herein, refers to a point along the height of a carry bag at which the bag is balanced when being carried.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

DESCRIPTION

Described herein is a detachable strap system 1 (herein referred to as a "strap system") configured to attach to a carry golf bag 2. The carry bag 2 can comprise a top and a body 6. The top and the body 6 can connect to form the carry bag 2. The top 3 comprises a divider top 4 and a handle 5 attached to the divider top 4. The carry bag 2 can further include a strap system 1 comprising a first strap 8*b*, a second strap 8*a*, and a connector (50*a*, 50*b*). One end of the first strap 8*b* comprises a first connector 50*b*. Similarly, one end of the second strap 8*a* comprises a second connector 50*a*. In many embodiments, each of the first and second straps (8*b*, 8*a*) are permanently attached to the first and second connector (50*b*, 50*a*), respectively. The first and second connectors (50*b*, 50*a*) removably fasten the first and second strap (8*b*, 8*a*) to the golf bag 2. The first and second connectors (50*b*, 50*a*) can have heterogeneous geometry that prevents improper installation and, in some embodiments, improves comfort and fit of the strap system 1 when worn by a user.

I. Connection Overview

Figure 12:
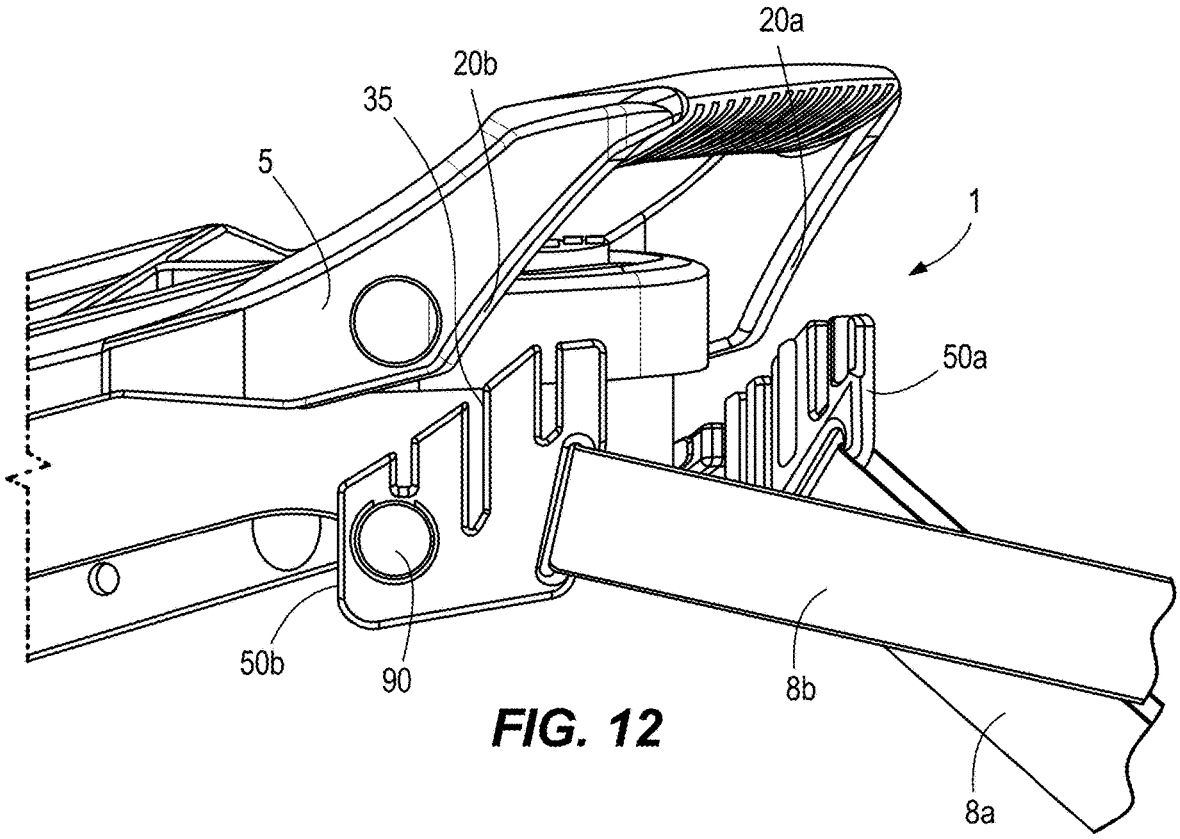
FIG. 12 a perspective view of the first and second connectors lined up with their respective slots in the golf bag of FIG. 4, according to the first embodiment.

Presented below is a strap system 1. The strap system 1 can comprise a first connector 50*b* and a second connector 50*a* that fit into integral harbors (20*b*, 20*a*) within the golf bag 2 top 3. The connectors (50*b*, 50*a*) can each be attached to a strap (8*b*, 8*a*) that is worn by the user on one shoulder or two shoulders to carry the golf bag 2. The golf bag 2 top 3 can comprise a first harbor 20*b* and a second harbor 20*a*, as illustrated in FIG. 12. The first harbor 20*b* is configured to be nearer to the user's dominant arm, while the second harbor 20*a* is configured to be further from the user's dominant arm. The first connector 50*b* is receivable by the first harbor 20*b* and the second connector 50*a* is receivable by the second harbor 20*a*. The first connector 50*b* and the second connector 50*a* have differing geometry. As such, the first connector 50*b* is nearer to the user's dominant arm while the second connector 50*a* is further from the user's dominant arm. The interior geometry of each harbor (20*b*, 20*a*) is complementary to an external geometry of the corresponding connector (50*b*, 50*a*). In many embodiments, the interior geometry of the first and second harbor (20*b*, 20*a*) are superimposable, mirrored versions of one another. In most embodiments, the interior geometry of the first and second harbor (20*b*, 20*a*) differ over each other. In any embodiment, the first harbor and second harbor (20*b*, 20*a*) will remain heterogeneous as the internal geometry of one comprises a mirror geometry of the other. The differing interior geometry of each harbor (20*b*, 20*a*) prevents the connectors (50*b*, 50*a*) from being put into the incorrect harbors (20*b*, 20*a*). As a result, the user cannot insert the connectors (50*b*, 50*a*) into the wrong first and second harbors (20*b*, 20*a*). This mitigates user error, reduces installation time, and simplifies the installation process.

Figure 2:
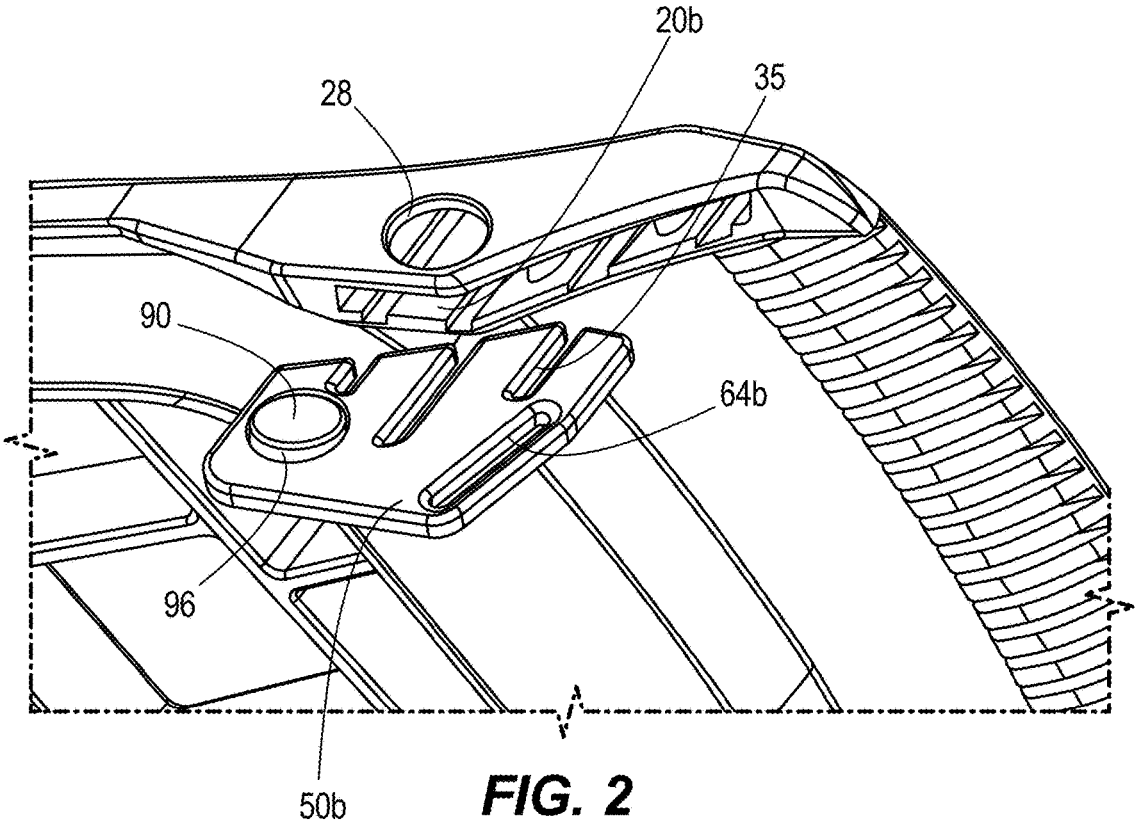
FIG. 2 illustrates a perspective view of a connector lined up with a corresponding divider top harbor, according to one embodiment
Figure 4:
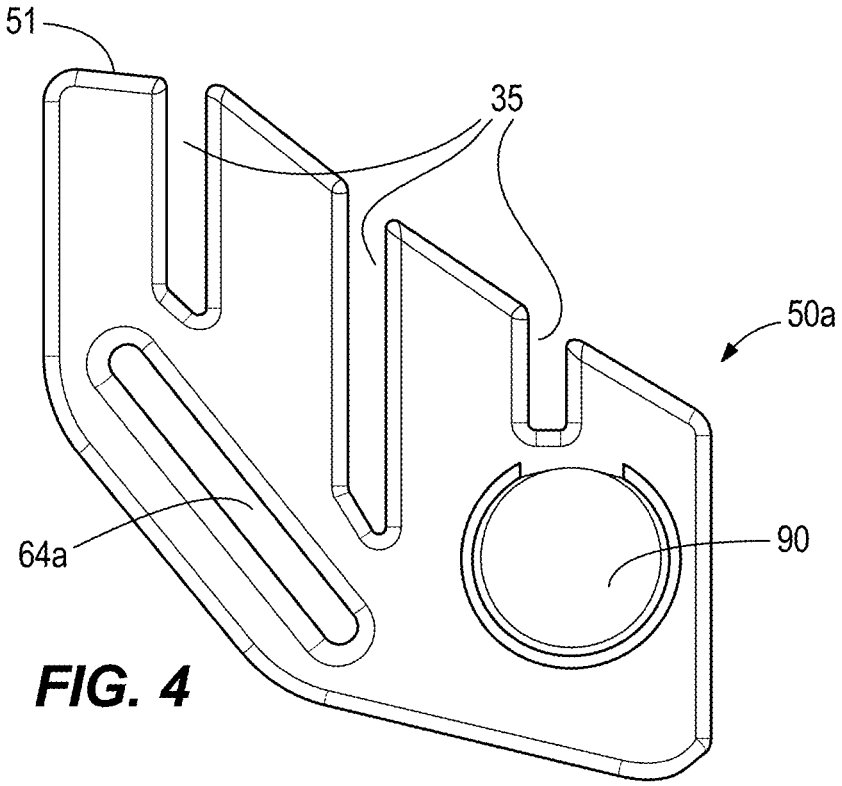
FIG. 4 illustrates an enlarged, outer side view of the second connector, according to the first embodiment.
Figure 5:
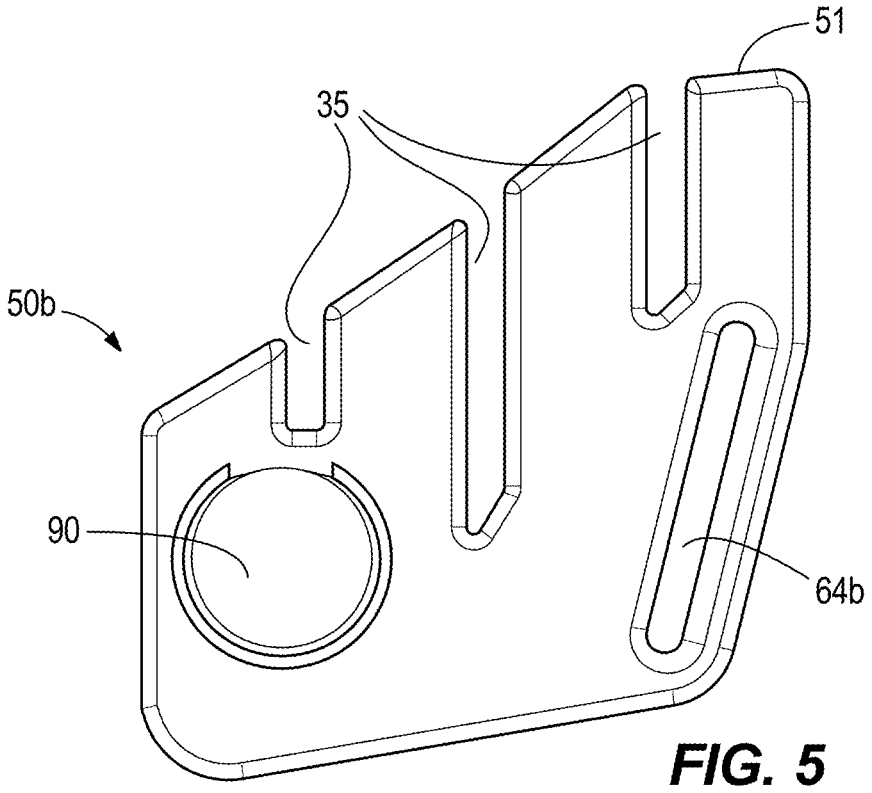
FIG. 5 illustrates an enlarged, outer side view of the first connector, according to the first embodiment.
Figure 6:
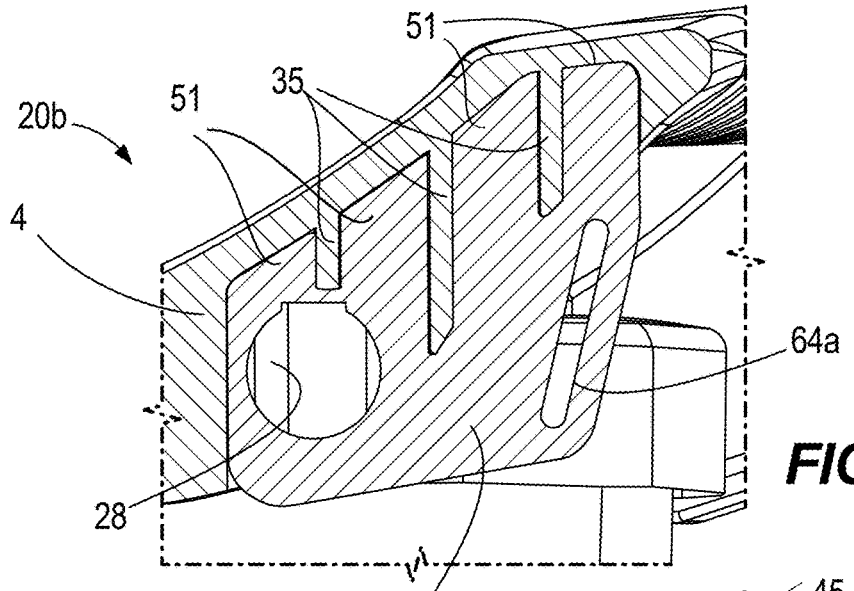
FIG. 6 illustrates a cross-sectional view depicting the internal structures of the first harbor as well as the ribs of the first connector of the golf bag of FIG. 1, according to the first embodiment.
Figure 7:
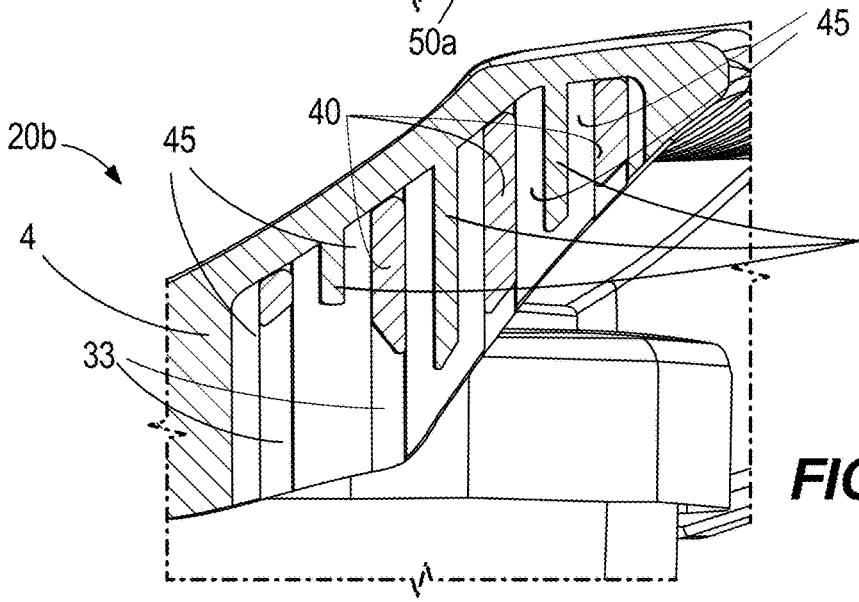
FIG. 7 illustrates a cross-sectional view depicting the internal structures of the first harbor as well as the ribs of the first connector of the golf bag of FIG. 1, according to the first embodiment.
Figure 8:
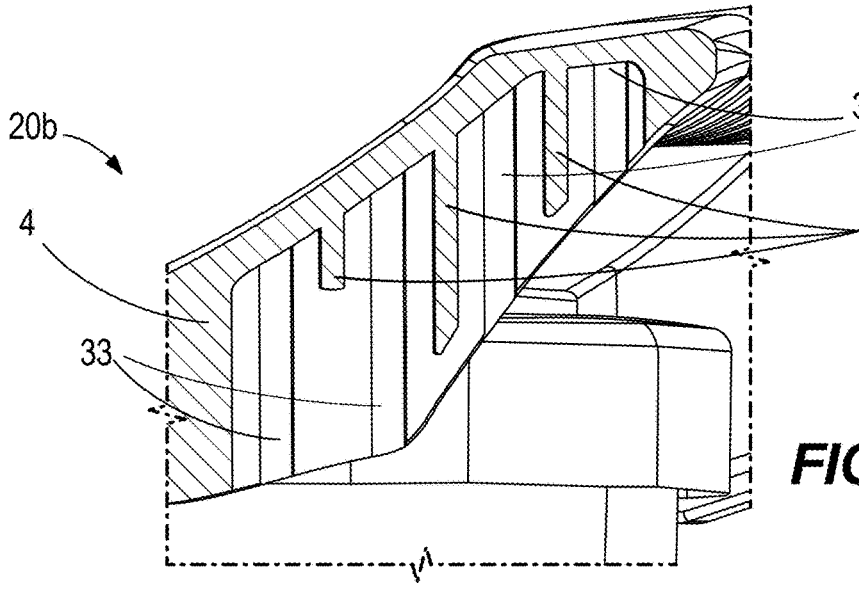
FIG. 8 illustrates a cross-sectional view depicting the internal structures of the first harbor as well as the ribs of the first connector of the golf bag of FIG. 1, according to the first embodiment.
Figure 9:
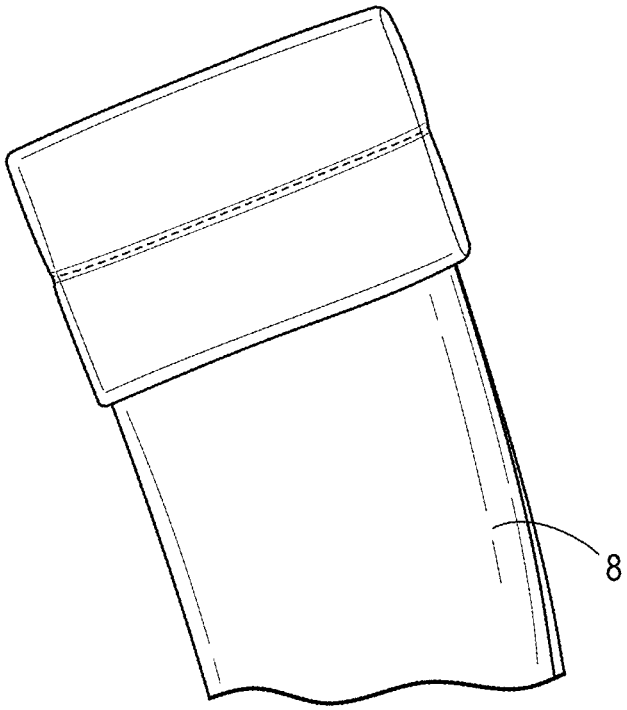
FIG. 9 (PRIOR ART)
FIG. 9 illustrates a front view of a current strap system, according to one embodiment.
Figure 10:
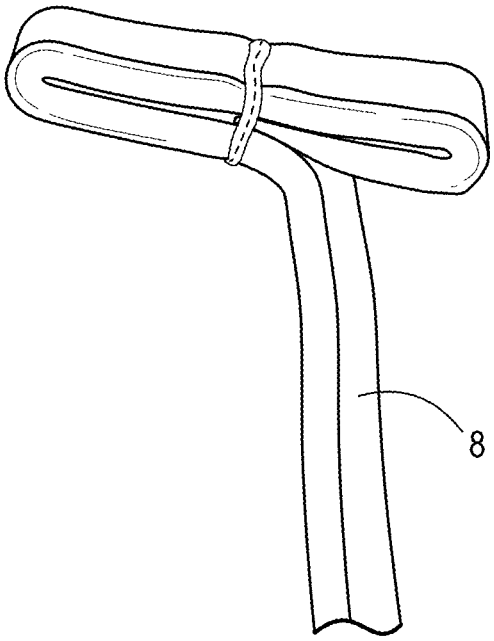
FIG. 10 (PRIOR ART)
FIG. 10 illustrates a side view of the strap system of FIG. 9.
Figure 11A:
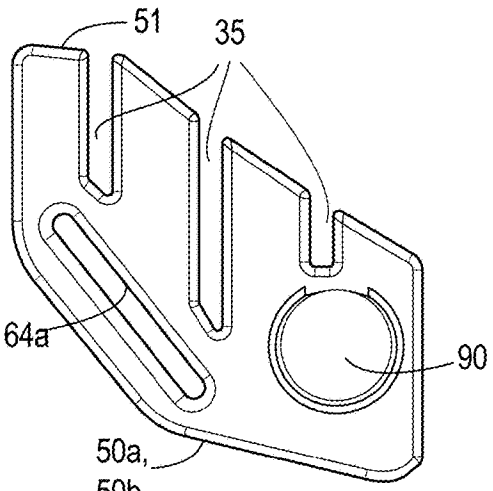
FIG. 11A-F illustrate various embodiments of a connector comprising a button.
Figure 11B:
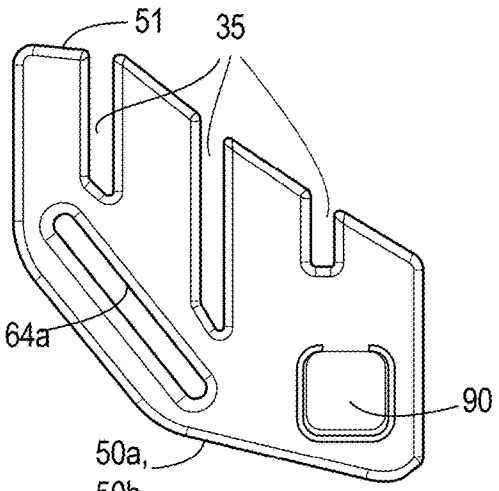
Figure 11C:
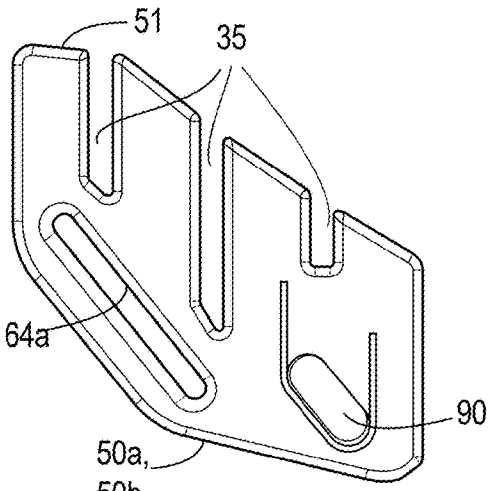
Figure 11D:
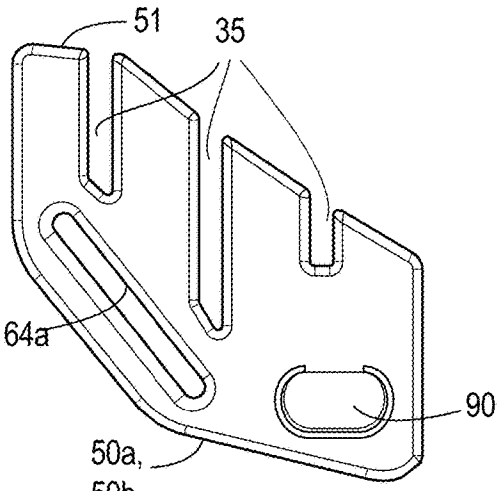
Figure 11E:
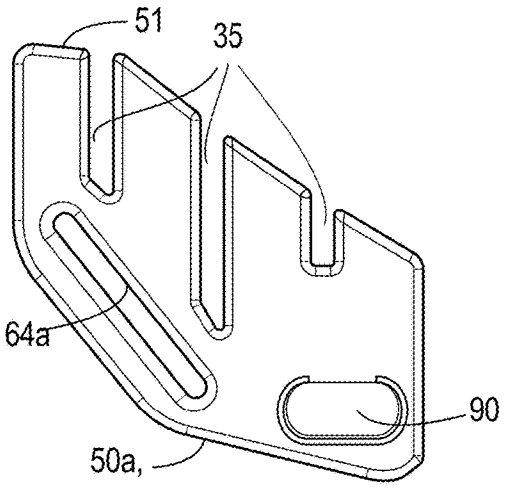
Figure 11F:
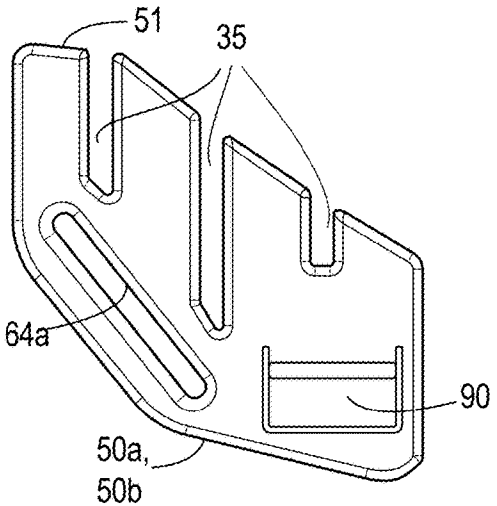
Figure 17:
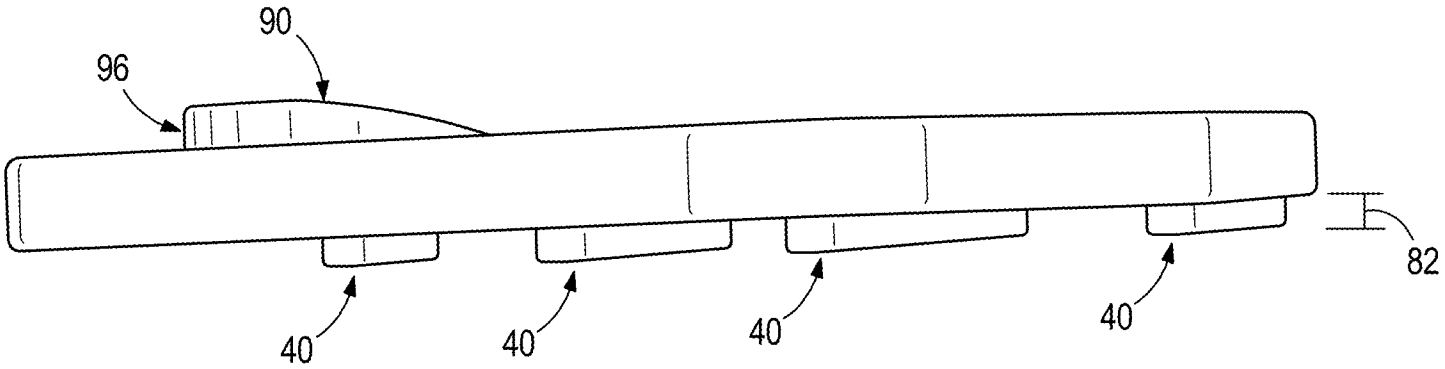
FIG. 17 illustrates an overhead view of a connector, according to one embodiment.

Referring to FIGS. 11A-11F, each connector (50*b*, 50*a*) comprises a top end, a bottom end, an outer side and an inner side. While these features are illustrated and described with reference to second connector 50*b*, they are applicable to both the first connector 50*b* and the second connector 50*a*. When assembled, the top end 52 is inside the harbor 20 and the bottom end and is protruding from the golf bag 2. When assembled, the outer side of each connector (50*b*, 50*a*) faces in a direction away from the golf bag 2 and the other connector. The inner sides of each connector (50*b*, 50*a*) face generally toward each other. As illustrated in FIGS. 4 and 5, each connector (50*b*, 50*a*) comprises one or more teeth 51, or a plurality of teeth 51, defining grooves 35 between the teeth 51 that extend between the outer and inner sides. As illustrated in FIG. 17, the inner side of the connector (50*b*, 50*a*) further comprises protrusions 40. The interior of the harbor (20*b*, 20*a*) comprises a plurality of slots 45, ribs 80, and tracks 33. The interior of the harbor (20*b*, 20*a*) comprises a plurality of ribs 80. The interior of the harbor (20*b*, 20*a*) comprises a plurality of tracks 33. The grooves 35 of the connector (50*b*, 50*a*) receive the ribs 80 of the harbor (20*b*, 20*a*) interior. The harbors (20*b*, 20*a*) receive the teeth 51 of the connector, as shown in FIG. 2. These interactions provide increased surface area abutment between the connector (50*b*, 50*a*) and the divider top 4. They also provide structural support and prevent lateral movement of the connector (50*b*, 50*a*) within the divider top 4.

The strap system 1 described herein can be incorporated into a wide range of golf bags. Many carry golf bags comprise a divider top 4. A divider top 4 comprising harbors (20*b*, 20*a*) complimentary to the connectors (50*b*, 50*a*) can receive, and therefore incorporate, the connectors (50*b*, 50*a*) with the above advantages. This allows the connectors (50*b*, 50*a*) to be combined with a variety of bag 2 configurations.

II. Heterogeneous Connectors

Figure 13:
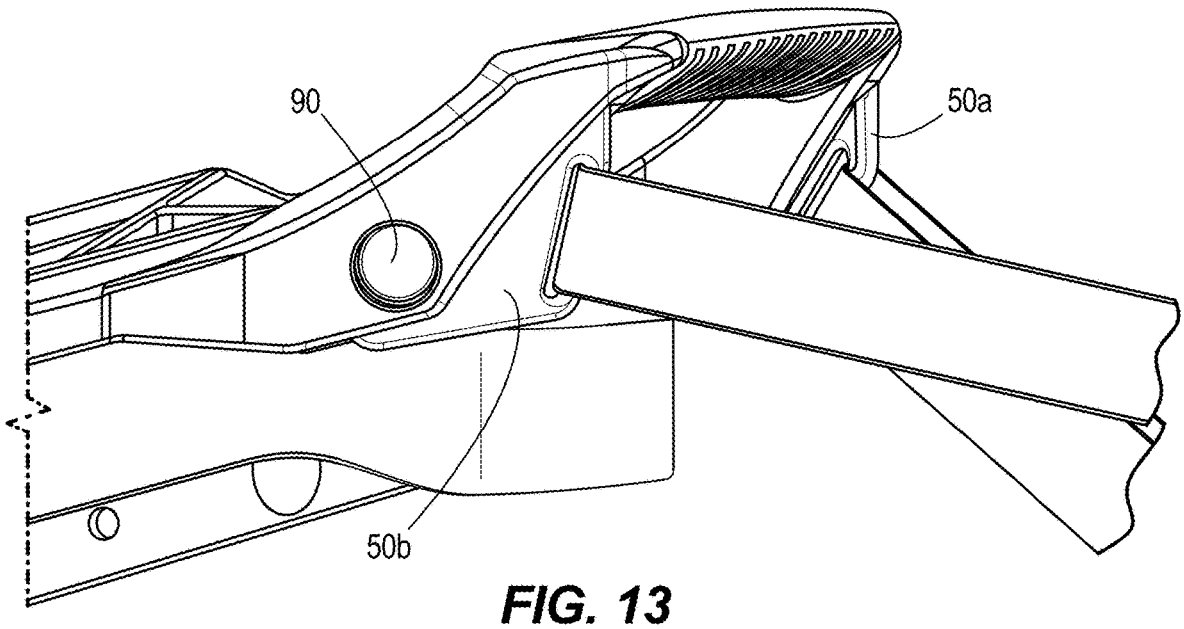
FIG. 13 illustrates a perspective view of the first and second connectors lined up with their respective harbors in the golf bag comprising a strap, according to one embodiment.
Figure 14:
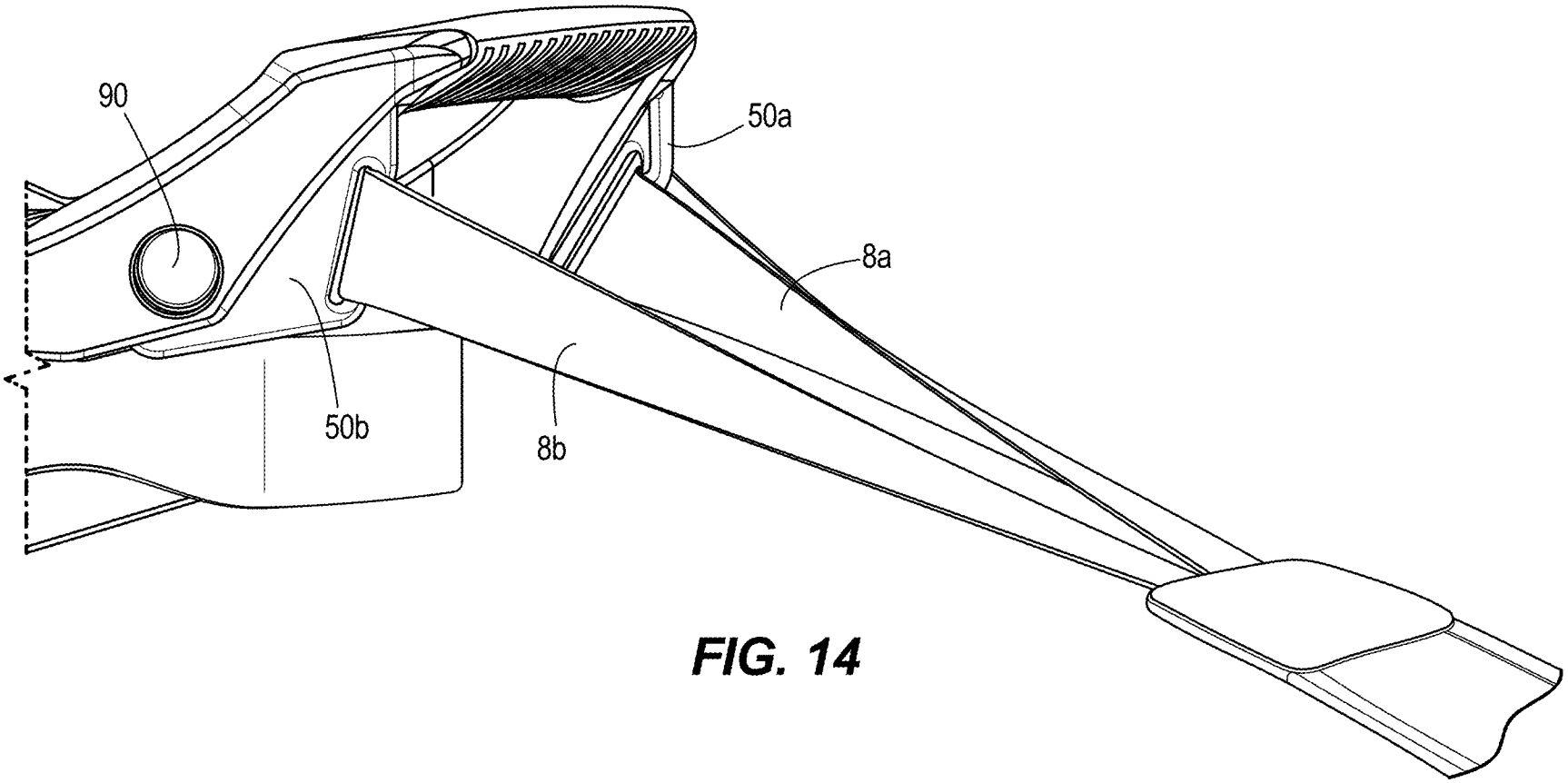
FIG. 14 illustrates a perspective view of the first and second connectors installed within their respective harbors comprising a strap according to the embodiment of FIG. 13.

The strap system 1 comprises a first connector 50*b*, a second connector 50*a*, a first strap 8*b*, and a second strap 8*a*. The first connector 50*b* and the second connector 50*a* can comprise a variety of heterogeneous features, such as geometry, surface area, and other factors discussed below. Referring to FIG. 13, in many embodiments, the second connector 50*a* and the first connector 50*b* comprise different geometries. In many embodiments, the second connector 50*a* and the first connector 50*b* comprise a geometry that is similar, but in some embodiments, not superimposable, to improve comfort based on the direction the bag 2 is worn (for right-hand dominant or left-hand dominant users). The user can be prevented from inserting a connector (50*b*, 50*a*) into an incorrect harbor (20*b*, 20*a*) by differing geometry in both superimposable and non-superimposable embodiments.

Figure 18A:
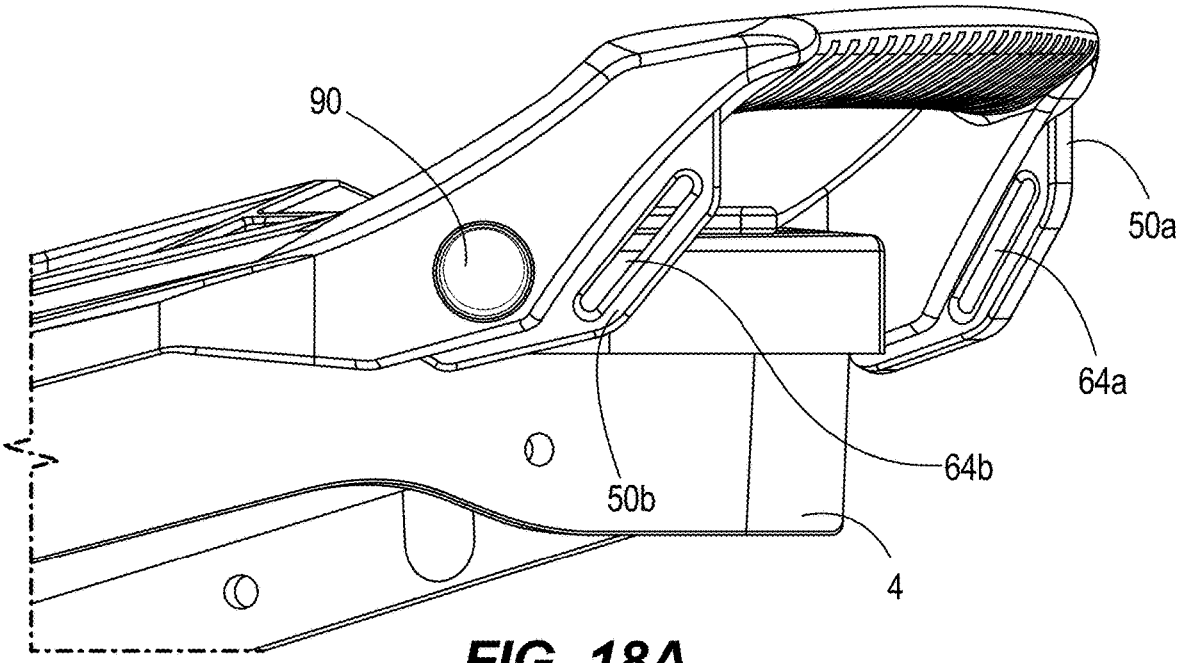
FIGS. 18A-18D illustrate the first and second connectors installed in their respective harbors, according to multiple embodiments.
Figure 18B:
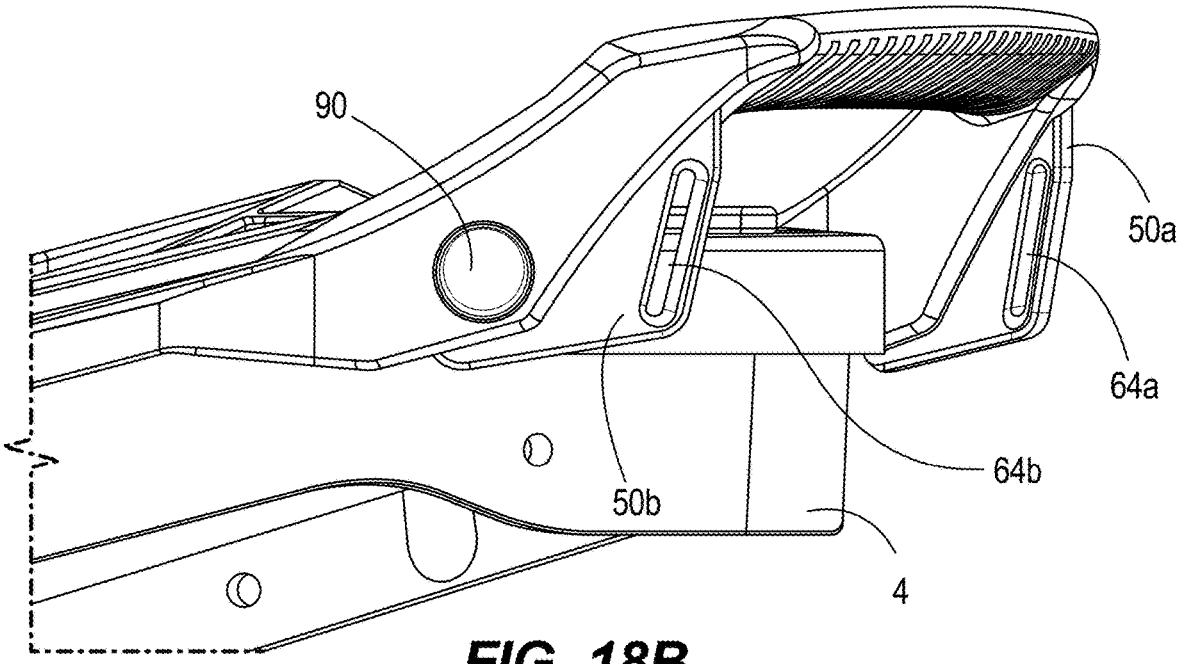

In some embodiments, including those illustrated in FIGS. 1-5, the second connector 50*a* and the first connector 50*b* can be chiral and not superimposable. In many of these embodiments, the portion of each connector (50*b*, 50*a*) that is received by its respective harbor (20*b*, 20*a*) is achiral, while the portion of each connector (50*b*, 50*a*) that receives the strap differs in structure and is, therefore, chiral and not superimposable. In other embodiments, including those illustrated in FIGS. 18A and 18B, the second connector 50*a* and the first connector 50*b* can be achiral and superimposable. The achiral connectors still prevent the user from inserting the connectors (50*b*, 50*a*) into incorrect harbors (20*b*, 20*a*).

Figure 15:
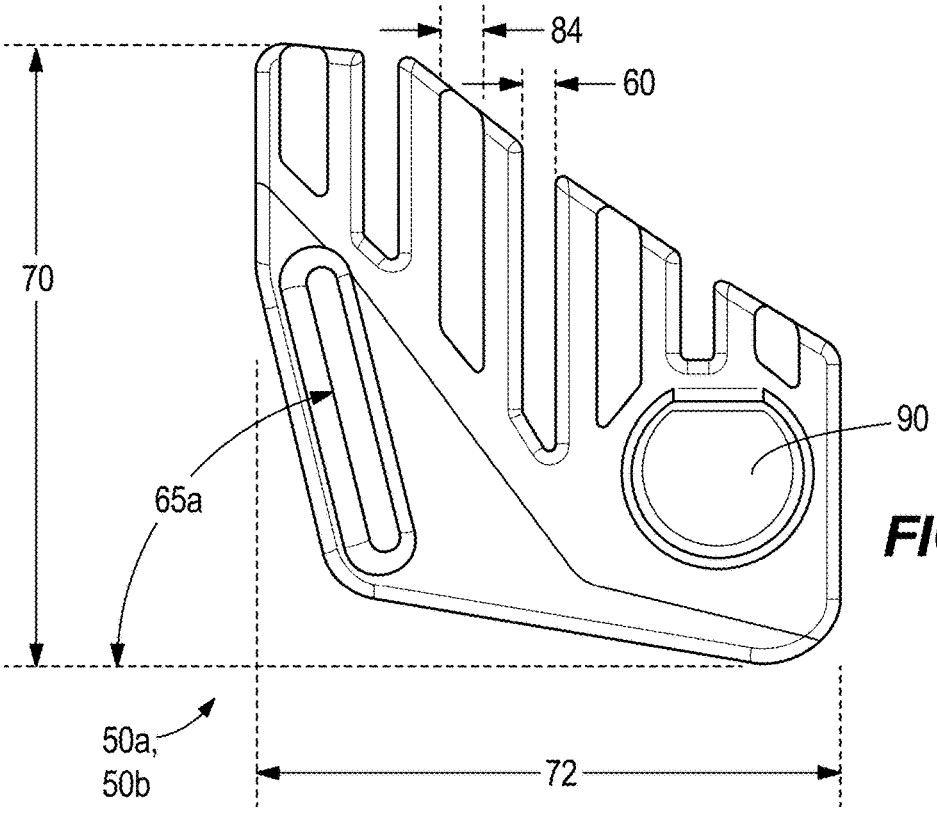
FIG. 15 illustrates an enlarged, inner side view of the first connector, according to the first embodiment.
Figure 16:
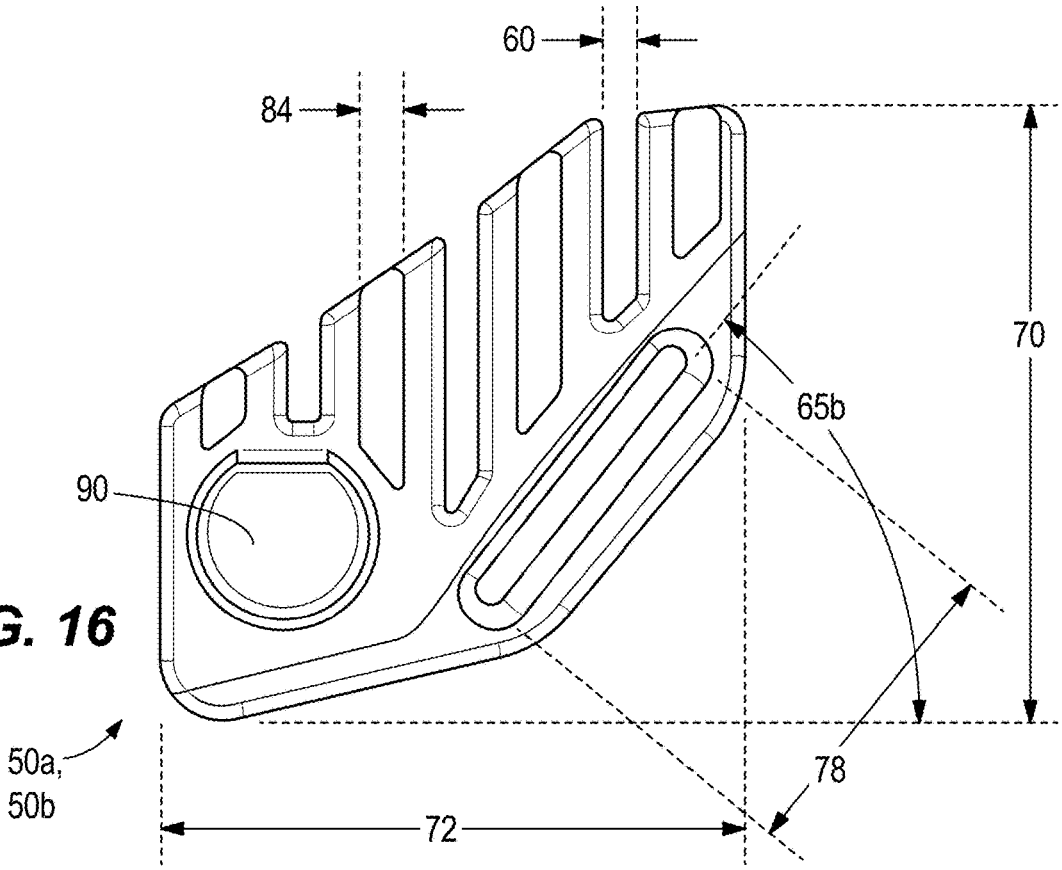
FIG. 16 illustrates an enlarged, inner side view of the second connector, according to the first embodiment.

The connectors each comprise a strap slot (64*a*, 64*b*) through which the straps (8*b*, 8*a*) can connect. The strap slot (64*a*, 64*b*) comprises a length 78. In these embodiments, the angle that the straps (8*b*, 8*a*) extend from the bag 2, or the strap slot angle 65, is different for each connector (50*a*, 50*b*). Referring to FIGS. 15 and 16, the strap slot angles (65*b*, 65*a*) are measured relative to the ground plane when the connectors are installed and the golf bag is at rest, in an upright position, and the stand assembly is not deployed. The strap slot angles (65*b*, 65*a*) cause the straps (8*b*, 8*a*) to extend from the bag 2 in such a way that provides maximum balance and comfort for the user. As shown in FIGS. 15-16, the first connector 50*b* comprises a strap slot that is angled to a differing degree, relative to the bag 2 body, than that of the second connector 50*a*. The angles of the first and second connectors 50*a*, 50*b* may differ in order to accommodate the dominant hand of the user. A right-handed user, for example, may carry the golf bag 2 in such a way that the divider top 4 rests against their right side. A left-handed user may carry the golf bag 2 in such a way that the divider top 4 lies against their left side. For this reason, the first and second connectors 50*a*, 50*b* can comprise differing strap slot angles (65*b*, 65*a*) in order to best accommodate the comfort of the user carrying the bag 2. The first strap slot 64*b* can comprise a first strap slot angle 65*b* greater than that of the second strap slot angle 65*a* in a right-handed user. The first strap slot 64*b* angle can be approximately 25 degrees greater than the second strap slot 64*a* angle. This allows the straps (8*b*, 8*a*) to extend from the divider top 4 without tangle or twisting, thus creating a comfortable and balanced hold on the bag 2.

Figure 19:
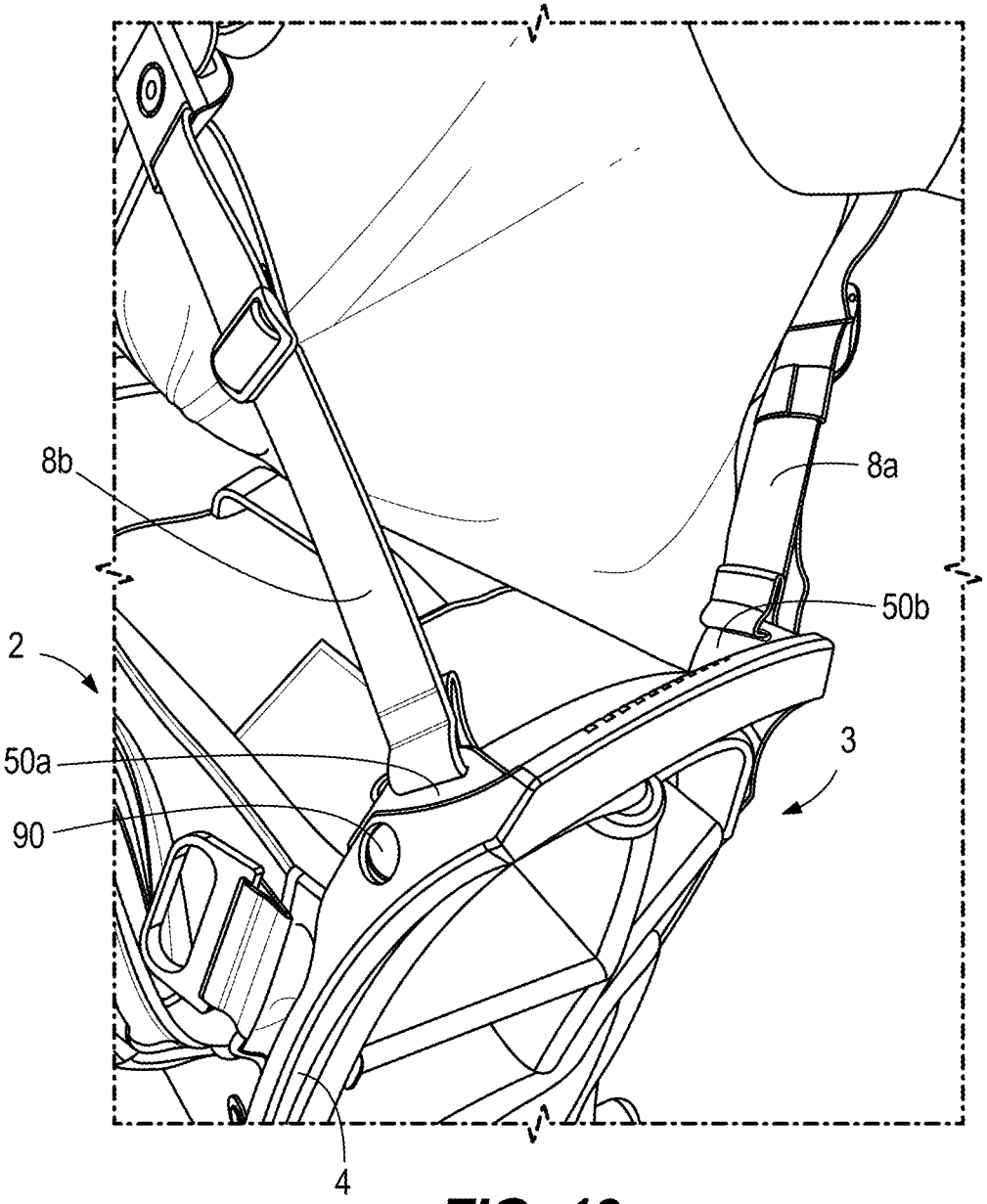
FIG. 19 illustrates a perspective view of the golf bag strap snap assembly carried by a user, according to one embodiment.
Figure 20:
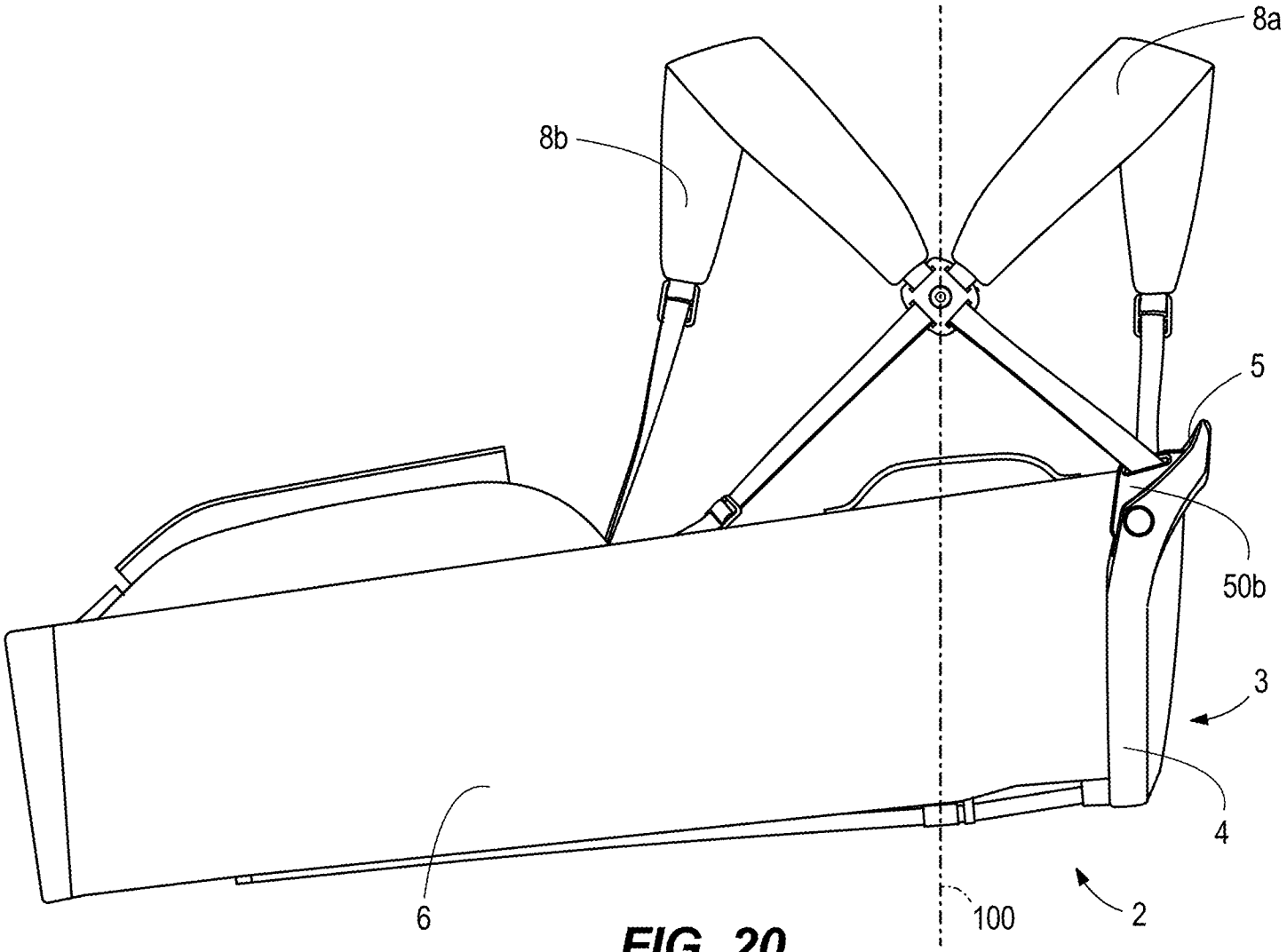
FIG. 20 illustrates a side view of a golf bag with a strap system according to one embodiment in the engaged position.

The coordination of the strap slot angles (65*b*, 65*a*) can reduce strap tangle. Reducing strap tangle improves both user experience and shipping. These benefits are detailed below. The strap slot (64*a*, 64*b*) is configured to be at an angle (65*a*, 65*b*) equal to the angle at which the strap will extend from the strap slot (64*a*, 64*b*). The angle of the strap slot (and therefore of the strap) guides the strap (8*a*, 8*b*) to lie flat off the connector (50*a*, 50*b*) when the bag 2 is being carried, as shown in FIG. 19. This prevents the straps (8*b*, 8*a*) from twisting against their connection point at the divider top 4 and becoming tangled or twisted. Further, if the straps (8*b*, 8*a*) were to become tangled, the connectors (50*b*, 50*a*) can easily be removed via unclipping. The straps (8*b*, 8*a*) can then easily be untangled or untwisted and reattached to the divider top 4 in a righted configuration.

The resulting configuration of the straps as a result of the angles of the first and second strap slots (64*b*, 64*a*) provide the greatest amount of space for the user's dominant arm. This can further prevent strap tangle by reducing how frequently the user may bump or interact with the straps (8*b*, 8*a*). This configuration can also promote the comfort of the user by preventing bumping or rubbing against the straps (8*b*, 8*a*) during use, which may cause irritation. The angles (65*a*, 65*b*) of the first and second strap slots (64*b*, 64*a*) guide the straps (8*b*, 8*a*) away from the dominant arm of the user. Because, in some embodiments, the first and second strap slots (20*b*, 20*a*) occur at heterogeneous angles, the angles (65*a*, 65*b*) of the strap slots (64*a*, 64*b*) can be modified to best guide the straps (8*b*, 8*a*) away from the user's arm for both right-handed and left-handed users.

The strap system 1 illustrated in FIGS. 1-3 and 18D depicts a configuration best suited for right-hand dominant users. In a right-hand dominant strap system, the first connector 50*b* (which is positioned nearest the user's right arm when worn), guides the strap (8*a*, 8*b*) away from the golf bag 2 in a direction that is more perpendicular to the golf bag 2 than that of the second connector 50*a*. Referring to FIGS. 15, the strap slot angles (65*a*, 65*b*) are measured relative to the ground plane when the connectors (50*a*, 50*b*) are installed and the golf bag is at rest, in an upright position, and the stand assembly is not deployed. The first strap slot 64*b* can be angled between 0 degrees and 90 degrees relative to the ground plane. The second strap slot 64*a* can be angled between 0 degrees and 90 degrees relative to the ground plane when the golf bag 2 is at rest in an upright position and not being worn. In some embodiments, the second strap slot 64*a* is between 40 degrees and 60 degrees. In many embodiments, the second strap slot 64*a* is between 40 and 45 degrees, 45 and 50 degrees, 50 degrees and 55 degrees, or between 55 and 60 degrees. In some embodiments, the first strap slot 65*a* is between 60 degrees and 90 degrees. In many embodiments, the first strap slot 64*b* is between 60 and 65 degrees, 65 and 70 degrees, 70 and 75 degrees, 75 and 80 degrees, 80 and 85 degrees, or between 85 and 90 degrees.

In many embodiments, the second strap slot 64*a* has a smaller angle 65*a* than that of the first connector 50*b* strap relative to the ground plane. The smaller angle of the second slot 64*a* and the larger angle 65*b* of the first slot 64*b* result in the first strap 8*b* extending in a direction more perpendicular to the golf bag than the second strap 8*a*. In other embodiments, the first connector 50*b* is a mirrored version of the second connector 50*a*. In any embodiment, the first connector 50*b* and the second connector 50*a* will remain heterogeneous, as their respective protrusions 40 will face opposite directions when mirrored.

Figure 18C:
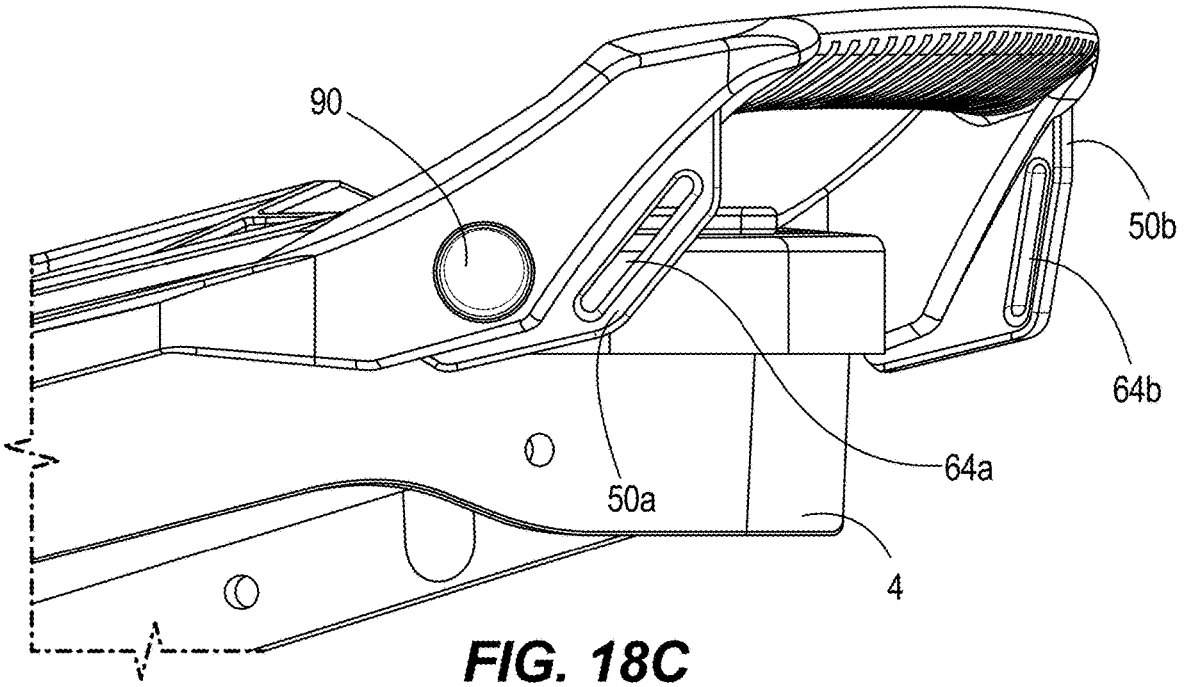
Figure 18D:
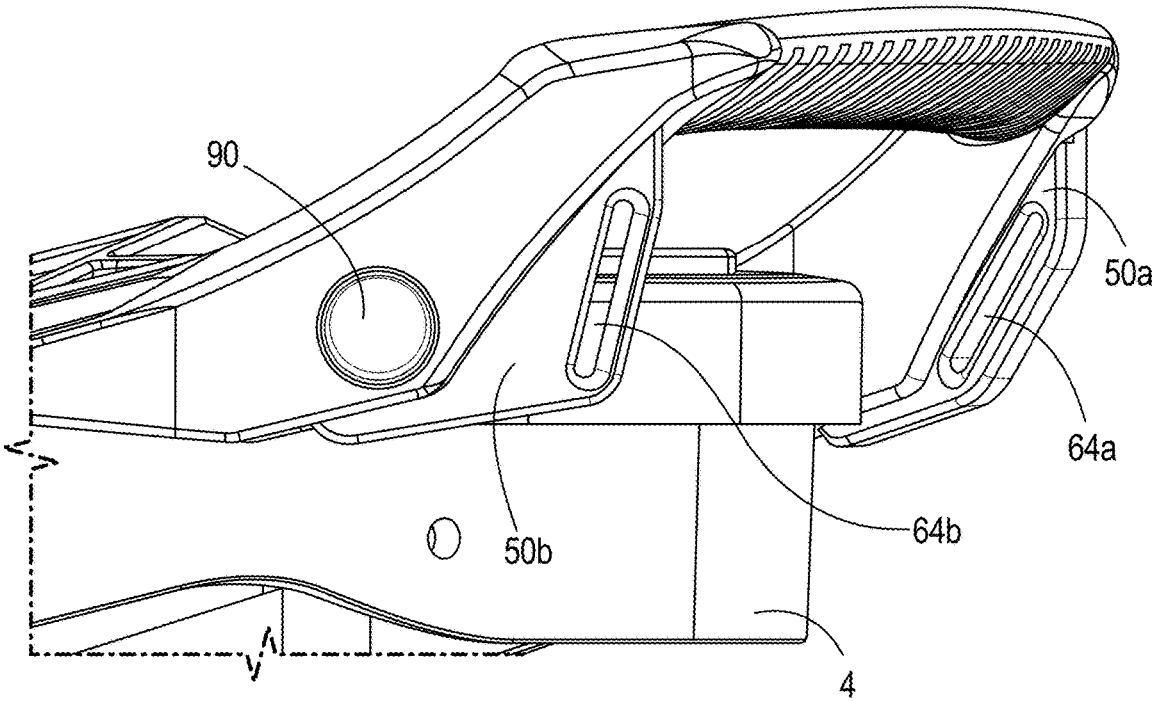

The strap system 1 illustrated in FIG. 18C depicts a configuration best suited for left-hand dominant users. In a left-hand dominant strap system, the first connector 50*b* (which is positioned nearest the user's left arm when worn), guides the strap away from the golf bag 2 in a direction that is more perpendicular to the golf bag 2 than that of the second connector 50*a*. Referring to FIGS. 16, the strap slot angles are measured relative to the ground plane when the connectors are installed and the golf bag is at rest, in an upright position, and the stand assembly is not deployed. In the left-hand dominant strap system, the first connector 50*b* and the second connector 50*a* are located in opposite positions when compared with the configuration of the right-hand dominant strap system. The first connector 50*b* is superimposed relative to the geometry of the first connector 50*b* in a right-hand dominant strap system 1. The geometry of the left-hand dominant first connector 50*b* is otherwise comparable or similar to that of the first connector 50*b* in a right-hand dominant strap system 1. The second connector 50*a* is superimposed relative to the geometry of the second connector 50*a* in a right-hand dominant strap system 1. The geometry of the left-hand dominant second connector 50*a* is otherwise comparable or similar to that of the second connector 50*a* in a right-hand dominant strap system.

The connector (50*a*, 50*b*) can have a height 70, a width 72, and a depth. The height 70 is measured in a direction perpendicular to the ground plane when the connector (50*a*, 50*b*) is installed, and the bag 2 is upright. In many embodiments, the height 70 can be between 1 inch and 2.25 inches. For example, the height 70 can be between 1.0 inch and 1.25 inches, 1.25 inches and 1.5 inches, 1.5 inches and 1.75 inches, 1.75 inches and 2.0 inches, or 2.0 inches and 2.25 inches. The width 72 is measured parallel to the ground plane and tangent to the handle 5 when the connector (50*a*, 50*b*) is installed, and the bag 2 is upright. In many embodiments, the width 72 can be between 1 inch and 2.25 inches. For example, the width 72 can be between 1.0 inch and 1.25 inches, 1.25 inches and 1.5 inches, 1.5 inches and 1.75 inches, 1.75 inches and 2.0 inches, or 2.0 inches and 2.25 inches. The depth is measured parallel to the ground plane and normal to the handle 5 when the bag 2 is in an upright position. The depth can be between 0.05 inches and 0.25 inches. In some embodiments, the height 70 is approximately 1.85 inches, and the width 72 is approximately 1.75 inches, as illustrated in FIGS. 12 and 13.

In embodiments comprising heterogeneous connectors (50*b*, 50*a*), the surface area of the first connector 50*b* can be greater than that of the second connector 50*a*. The surface area of the first connector 50*b* can be greater than the surface area of the second connector 50*a* in order to accommodate a larger strap slot angle 65. The surface area of the first connector 50*b* can be approximately 0% to 20% greater than the surface area of the second connector 50*a*. In many embodiments, the surface area of the first connector 50*b* can be between 0% and 5%, 5% and 10%, 10% and 15%, or between 15% and 20% greater than the surface area of the second connector 50*a*.

As mentioned above, the connector (50*a*, 50*b*) can comprise both teeth 51 and grooves 35. In some embodiments, the connector comprises at least one tooth. For example, in some of these embodiments, as illustrated in FIGS. 16 and 17, the connector (50*a*, 50*b*) comprises four teeth 51. The teeth 51 can be located between grooves 35 and can extend from the connector top end in a direction toward the connector bottom end. The teeth 51 can be integrally formed to the connector (50*a*, 50*b*) and can protrude from the inner side of the connector. The teeth 51 can comprise a depth, a width, and a length. The protrusion depth 82 can be smaller than the depth of the connector (50*a*, 50*b*). The protrusion depth 82 helps to guide the first and second connectors (50*b*, 50*a*) into their respective harbors (20*b*, 20*a*) as well as strengthen the first and second connectors (50*b*, 50*a*) when the strap system is engaged. In many embodiments, the protrusion depth 82 can be between approximately 20% and 70% of the connector depth. In many embodiments, the protrusion depth 82 can be between 20% and 30%, 30% and 40%, 40% and 50%, 50% and 60%, or between 60% and 70% the connector depth. The protrusion width 84 can be smaller than a distance 60 between adjacent teeth 51. The protrusions 40 can have a top end that is flush with the connector top end.

During installation, the top end of the connector 50 can be slid into the harbor (20*a*, 20*b*). The teeth 51 can be removably coupled with the harbor slots 45. The protrusions 40 can fit snuggly within the harbor tracks 33, with minimal gapping between the ribs 80 and tracks 33. If the grooves 35 and ribs 80 are not properly aligned, the connector (50*a*, 50*b*) will be prevented from being received by the harbor (20*a*, 20*b*).

III. Fastening Mechanism

Figure 3:
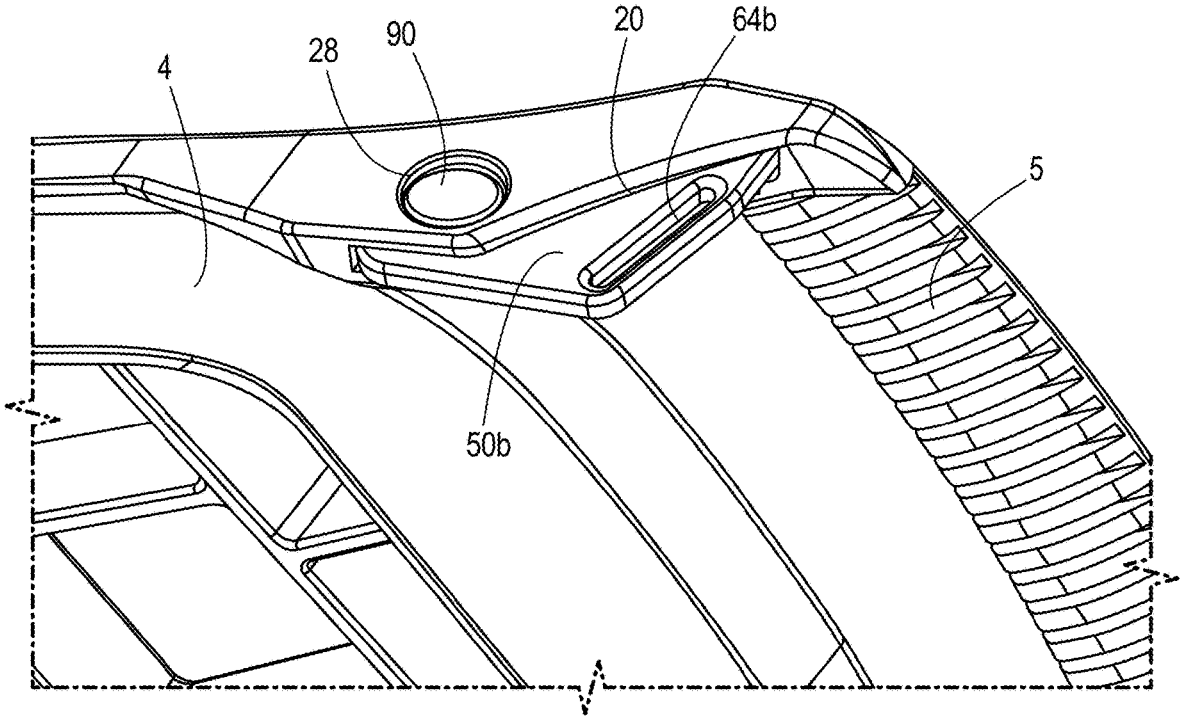
FIG. 3 illustrates a perspective view of a connector installed within the divider top harbor, according to the embodiment of FIG. 2.

In some embodiments, the connector fastens into the slot with a "snap-in" connection. In the illustrated embodiment, this connection involves a button 90. In some embodiments, the button 90 can be integrally formed with the connector (50*b*, 50*a*). At least a portion of the button 90 protrudes slightly from the surrounding connector. As shown in FIGS. 2 and 3, the button 90 is detached from the connector (50*b*, 50*a*) around a portion of its perimeter 96, while the upper 10%-30% of the perimeter 96 is integral with the rest of the connector (50*b*, 50*a*). For example, 10%-15%, 15%-20%, 20%-25%, or 25%-30% of the perimeter 96 can be integral with the rest of the connector (50*b*, 50*a*). The button 90 is flush with the surrounding connector (50*b*, 50*a*) at the top, integral portion, and protrudes furthest from the connector (50*b*, 50*a*) at the bottom, opposite the integral portion. The flexibility of the small connection at the button 90 top allows the button 90 to be moved slightly forward and back, and it can be pressed so that it lies entirely flush with the connector (50*b*, 50*a*). The button 90 protrudes beyond the aperture 28 such that it applies pressure to the golf bag 2 top 3 and is unable to slide out of the aperture 28.

The first and second harbor 20*a* define an aperture 28 that corresponds to the geometry of the connector's button 90, shown in FIGS. 1-3. To attach the straps (8*b*, 8*a*) to the bag 2, the user slides the connector into its corresponding harbor (20*b*, 20*a*) in the proper orientation. Once the button 90 is completely within the perimeter 96 of the corresponding aperture 28, the interaction will make a "snap" sound, notifying the user that the connector (50*b*, 50*a*) is in place.

In this configuration, the button 90 protrudes beyond the aperture 28, and a wall of the button 90 abuts a wall of the aperture 28. As a result, once installed, the connector will not slide out of the slot if the user tugs on the straps (8*b*, 8*a*). To remove the straps (8*b*, 8*a*) from the bag 2, the user presses the button 90 so that it lies flush with the connector (50*b*, 50*a*). While keeping the button 90 compressed, the user can slide the connector (50*b*, 50*a*) back out of the harbor (20*b*, 20*a*).

In some embodiments, the button 90 is integrally formed with the connector (50*b*, 50*a*). In the illustrated embodiment, the button 90 is circular in shape. In other embodiments, the button 90 can be a rectangle, triangle, oval, or any other polygonal shape. In other embodiments, the button 90 can be spring-loaded and not integrally formed with the connector (50*b*, 50*a*). In further embodiments, the connectors (50*b*, 50*a*) are fastened by other methods, including press-fit, clamping, bolting, or other mechanical fastening method. Finally, other embodiments can have a snap-in connection that utilizes a region of the connector (50*b*, 50*a*) other than the button 90 of the illustrated embodiment.

IV. Shipping

Previous strap connection designs result in undesirable crushing and creasing of the straps (8*b*, 8*a*) if the bag 2*s* are shipped with the straps (8*b*, 8*a*) fully attached. To mitigate unwanted creasing, bag 2*s* are shipped from the supplier with the straps (8*b*, 8*a*) unattached to the golf bag 2. Typically, additional manufacturing steps need to be taken such as sewing, folding, or attaching additional parts to allow the strap system 1 to be able to attach to the golf bag 2. The strap system 1 described herein can allow the straps (8*b*, 8*a*) to be easily pressed into place without necessary modifications.

The strap system 1 described herein allows the straps (8*b*, 8*a*) to be attached or unattached when the bag 2 is shipped. The location of attachment and the angle that the straps (8*b*, 8*a*) extend from the bag 2 reduces crushing and creasing of the straps (8*b*, 8*a*) when packaged for shipping. Unattached straps (8*b*, 8*a*) can be extended as needed to completely mitigate crushing and creasing. The unattached straps (8*b*, 8*a*) can be easily installed by the user, and do not require assembly prior to shipping to the consumer, thereby reducing assembly time, improving appearance, and preventing flaws.

V. Materials

In many embodiments, the connectors (50*b*, 50*a*) can be made up of a plastic material or blend, such as polyoxymethylene (POM), nylon, polyethylene, polypropylene, polycarbonate, or other plastic or plastic-based blend. In some embodiments, the connectors (50*b*, 50*a*) can be made up of glass-reinforced polypropylene or glass-filled nylon. In other embodiments, the connectors (50*b*, 50*a*) can be made up a metallic material. In some of these embodiments, the connectors (50*b*, 50*a*) are made of a different material than the golf bag 2 top 3. In some embodiments, different parts of the connector comprise different materials.

The straps (8*b*, 8*a*) can comprise a material. In many embodiments, the straps (8*b*, 8*a*) can comprise a material such as polyester, nylon, cotton, or other suitable materials. In some embodiments, the straps (8*b*, 8*a*) comprise more than one material. In some embodiments, the straps (8*b*, 8*a*) comprise entirely the same material.

VI. Advantages

The strap system 1 described herein reduces strap tangle, simplifies the assembly process, accommodates the dominant hand of the user, and promotes comfort. The angle of the strap slots encourages the straps (8*b*, 8*a*) to lie flat when the bag 2 is being carried. This prevents twisting and adds additional space for the arm of the user through the straps (8*b*, 8*a*). The strap system also encourages the straps (8*b*, 8*a*) to remain in place and reduces strap tangle. The ability of the connectors (50*b*, 50*a*) to snap into the divider top 4 allows for easy assembly as well as removal if the straps (8*b*, 8*a*) do happen to become tangled. The connectors (50*b*, 50*a*) can comprise heterogeneous geometry. This ensures the user places the connectors (50*b*, 50*a*) into their proper, corresponding harbors (20*b*, 20*a*) within the divider top 4. Further, the connectors (50*b*, 50*a*) can comprise heterogeneous strap slot angles (65*b*, 65*a*). The heterogeneous strap slot angles (65*b*, 65*a*) can allow the straps (8*b*, 8*a*) to lie flat when the golf bag 2 is being carried by a left-handed or right handed user. When the straps (8*b*, 8*a*) lie flat, they are less likely to twist or rub against the user. As such, the strap system 1 discourages strap tangle and encourages comfort.

The strap system 1 further promotes comfort by distributing weight evenly between the left and right side of a user despite their dominant hand. The strap system 1 accomplishes this by raising the balance point 100 of the strap system 1. The position at which the bag 2 is most comfortable for carrying can be defined by angle between the bag 2 and the ground plane. A bag 2 with a higher balance point 100 is more comfortable to carry at an angle acute to the ground plane. A bag 2 with a lower balance point 100 is more comfortable to carry at an angle larger than a bag 2 with a high balance point 100. This angle ensures the position at which the user is carrying the bag 2 is most comfortable by moving the bag 2 into a position closely parallel to the ground when the strap system 1 is in use. This ensures the weight of the bag 2 will be evenly distributed between the first and second straps (8*b*, 8*a*) of the strap system 1. Evenly distributed weight prevents strain on any one side of the user. As described above, a strap system 1 with a higher balance point 100 is more comfortable to carry at an angle closer to the ground plane than a strap system 1 with a lower balance point 100. Thus, it is advantageous to the comfort of the user to establish a strap system 1 with a higher balance point 100.

A higher balance point can be accomplished by connecting the straps (8*b*, 8*a*) to the bag 2 at a location closer to the top of the bag 2. The connectors (50*b*, 50*a*) described herein connect directly to the divider top 4. Existing strap systems primarily connect to a point below the divider top 4, thus lowering the balance point 100. This creates an uneven distribution of weight across existing strap systems when a bag is being carried by a user. Such uneven distribution can make existing strap systems difficult to use, and can also cause pain or discomfort.

VI. Examples

Example 1

The balance point 100 of an exemplary strap system 1 and a standard strap system 1 was measured to determine how parallel the bag body connected to each strap system 1 would naturally fall in reference to the ground when the strap system was engaged. When engaged, a bag is positioned by a strap system as though it was being carried by a user. In this engaged position, the bag body hangs from the strap system at an angle closely horizontal in reference to the ground. The exemplary strap system in this example comprised heterogeneous connectors (50*b*, 50*a*), wherein the connectors (50*b*, 50*a*) attach at the highest point of the bag 2. The standard strap system 1 in this example comprised homogeneous connectors (50*b*, 50*a*), wherein the connectors (50*b*, 50*a*) attach at a point on or below the divider top 4. As stated prior, a bag more parallel to the ground is more likely to distribute weight more evenly across a user's shoulders than a bag with an angle away from the ground. Therefore this angle between the bag body and the ground is a strong indicator of how comfortable a strap system 1 will be to carry. This angle can be determined by a variety of factors, the largest of which is the balance point 100 of the strap system 1 when the strap system 1 is engaged. The balance point 100 occurs near the middle of the strap system. Because most strap systems 1 strap system is connect near the middle and top of the bag 2, this balance point 100 typically occurs at a point within the top 20-25% the height of the bag 2.

The exemplary strap system 1 comprising a heterogeneous connectors (50*b*, 50*a*) at the top of the bag 2 was found to have a balance point 100 that occurred at a point 20% the height of the bag 2. The angle of the exemplary strap system 1 in reference to the ground when being carried was found to be 10 degrees. The standard strap system 1 comprising homogeneous connectors (50*b*, 50*a*) at a lower point on the bag 2 was found to have a balance point 100 that occurred at the top 25% the height of the bag 2. The angle of the standard strap system in reference to the ground when being carried was found to be 18 degrees.

These results show the exemplary strap system 1 comprising heterogeneous connectors (50*b*, 50*a*) at a topmost point on the bag 2 results in a balance point 100 higher on the bag 2 as well as a position more parallel to the ground when in use when compared to the standard strap system 1 comprising a homogeneous connectors (50*b*, 50*a*) wherein the straps (8*b*, 8*a*) connect at a lower point along the bag 2 height. The standard strap system 1 in this example resulted in a bag 2 angle less parallel to the ground as well as a balance point 100 lower along the height of the bag 2. A higher balance point 100 and bag 2 angle parallel to the ground indicate a comfortable strap system 1. As such, these results indicate the exemplary strap system 1 described herein would better distribute bag 2 weight across the user's sides, creating a more comfortable strap system 1.

Example 2

The amount of space created for the user's arm between straps (8*b*, 8*a*) in an exemplary strap system 1 as described herein was compared to the space created in a standard strap system when the strap systems were engaged. The exemplary strap system 1 of this example comprises a heterogeneous two-strap connection to a golf bag 2. The standard strap system 1 comprises a symmetric two strap connection to a golf bag 2.

The heterogeneous two-strap connection of the exemplary strap system 1, as shown in FIG. 19, comprises a first connector and a second connector. When held by the user, the first connector of the exemplary strap system 1 creates an angle off the bag 2 body 6. The second connector of the exemplary strap system 1 also creates an angle off the bag 2 body 6. Because the arm of the user fits between these strap connectors (50*b*, 50*a*), a larger angle indicates greater space created for the user's arm. The angle of the strap between the left connector and bag 2 body 6 of the exemplary strap system 1 is between 75 and 85 degrees. The angle of the strap formed between the right connector and bag 2 body of the exemplary strap system 1 is between 80 and 90 degrees.

The symmetric two strap connection of the standard strap system 1 comprises a homogeneous first connector and second connector. The left connector and right connector create an angle between the strap and bag 2 body 6 when held by a user. The angle of the strap between the first connector and the bag 2 body 6 of the standard bag 2 is between 70 and 80 degrees. The angle of the strap between the second connector and the bag 2 body of the standard strap system 1 is between 60 and 70 degrees.

Larger angles between the bag 2 body 6 and straps (8*b*, 8*a*) of the golf bag 2 allow for a greater range of space for the user's arm. A greater range of space for the user's arm ensures the user will be more comfortable when carrying the strap system 1, as the straps (8*b*, 8*a*) will not rub or bump against the user with movement. The first connector of the exemplary strap system 1 created an average of 5 degrees more space than the first connector of the standard strap system 1. The second connector of the exemplary strap system 1 created an average of 20 degrees more space than the second connector of the standard strap system 1. The exemplary strap system 1 comprising a heterogeneous two-strap connection as described above creates larger angles between the bag 2 body 6 and straps (8*b*, 8*a*) than a standard strap system without such a heterogeneous two-strap connection. This additional space could provide a better range of motion, the strap system 1 is less likely to rub against the user, and jostling of the straps (8*b*, 8*a*) is less likely to occur and create strap tangle. As such, the exemplary strap system 1 comprising a heterogeneous two-strap system is more comfortable for a user.

Clause 1: A golf bag comprising a golf bag top comprising a divider top and a handle; a base; a flat extending between the divider top and the base; and a strap system, the strap system comprising a strap and a connector; wherein: the strap system comprises a strap and a connector; the connector comprises a strap slot configured to receive the strap; the divider top defines a harbor configured to receive the connector; the harbor comprises a plurality of ribs, a plurality of slots, and a plurality of tracks; wherein adjacent ribs form the slots; wherein tracks are recessed into the ribs; the connector comprises a plurality of teeth, a plurality of grooves, and a plurality of protrusions; wherein adjacent teeth form the grooves; wherein the protrusions extend along a length of the teeth; the slots of the harbor are configured to receive the teeth of the connector; the grooves of the connector are configured to receive the ribs of the harbor; and the tracks of the harbor are configured to receive the protrusions of the connector.

Clause 2: The golf bag of clause 1, wherein the connector is removably coupled to the harbor of the divider top.

Clause 3: The golf bag of clause 1, wherein the strap system comprises a second strap and a second connector; and wherein the divider top defines a second harbor opposite the harbor, the second harbor configured to receive the second connector.

Clause 4: The golf bag of clause 1, wherein the strap slot is angled with respect to the teeth of the connector.

Clause 5: The golf bag of clause 1, wherein the connector comprises a button integrally formed with the connector; wherein the harbor defines a button aperture; and wherein the button aperture is configured to receive the button.

Clause 6: The golf bag of clause 1, wherein the golf bag is at rest in an upright position when the golf bag extends perpendicular to a ground plane; and wherein when the connector is engaged with the harbor and the golf bag is in the upright position, the strap slot is angled from the ground plane between 0 and 90 degrees.

Clause 7: The golf bag of clause 3, wherein the handle of the divider top is between the first harbor and the second harbor.

Clause 8: The golf bag of clause 7, wherein a first angle is defined between the slot of the first connector and the ground plane and a second angle between the second strap slot of the second connector, and wherein the second angle is smaller than the first angle.

Clause 9: The golf bag of clause 7, wherein a geometry of the teeth of the first connector is different than a geometry of the teeth of the second connector.

Clause 10: The golf bag of clause 3, wherein the handle of the divider top is between the first harbor and the second harbor.

Clause 11: A golf bag comprising: a golf bag top comprising a divider top and a handle; a base; a flat extending between the divider top and the base; and a strap system, the strap system comprising a strap and a connector; wherein: the strap system comprises a strap and a connector; the connector comprises a strap slot configured to receive the strap; the divider top defines a harbor configured to receive the connector; the harbor comprises a plurality of ribs, a plurality of slots, and a plurality of tracks; wherein adjacent ribs form the slots; wherein tracks are recessed into the ribs; the connector comprises a plurality of teeth, a plurality of grooves, and a plurality of protrusions; wherein adjacent teeth form the grooves; wherein the protrusions extend along a length of the teeth; the slots of the harbor are configured to receive the teeth of the connector; the grooves of the connector are configured to receive the ribs of the harbor; the tracks of the harbor are configured to receive the protrusions of the connector; the connector is releasably engageable with the harbor via a snap-fit mechanism, the snap fit mechanism comprising a button protruding from the connector and an aperture formed within the harbor; the aperture and the button comprise complementary geometries; the button is received within the aperture such that the button abuts a wall of the aperture; and the connector is releasable from the harbor by pressing the button.

Clause 12: The golf bag of clause 11, wherein the connector is removably coupled to the harbor of the divider top.

Clause 13: The golf bag of clause 11, wherein the strap system comprises a second strap and a second connector having a second strap slot; and wherein the divider top defines a second harbor opposite the harbor, the second harbor configured to receive the second connector.

Clause 14: The golf bag of clause 11, wherein the strap slot is angled with respect to the teeth of the connector.

Clause 15: The golf bag of clause 11, wherein the button is integral with the connector.

Clause 16: The golf bag of clause 15, wherein a portion of a perimeter of the button is flush with a portion of the connector surrounding the button.

Clause 17: The golf bag of clause 13, wherein the golf bag is at rest in an upright position when the golf bag extends perpendicular to a ground plane; and wherein when the connector is engaged with the harbor and the golf bag is in the upright position, the strap slot and the second strap slot are angled from the ground plane between 0 and 90 degrees.

Clause 18: The golf bag of clause 17, wherein a first angle is defined between the strap slot and the ground plane and a second angle is defined between the second strap slot of the second connector, and wherein the second angle is smaller than the first angle.

Clause 19: The golf bag of clause 17, wherein a geometry of the teeth of the first connector is different than a geometry of the teeth of the second connector.

Clause 20: The golf bag of clause 13, wherein the handle of the divider top is between the first harbor and the second harbor.

As the rules of golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard, unless expressly stated otherwise.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that any element of FIG. 1 may be modified, and that the foregoing discussion of certain of these embodiments does not necessarily represent a complete description of all possible embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf bag, comprising:

a body;

a divider top coupled to the body, the divider top including:

a first harbor, having:

a first plurality of ribs; and a first plurality of slots disposed between adjacent pairs of ribs of the first plurality of ribs;

a first connector configured to be releasably coupled to the first harbor, the first connector including:

a first connector top end entirely received by the first harbor when the first connector is coupled to the first harbor, the first connector top end including:

a first plurality of teeth, wherein each tooth of the first plurality of teeth is sized for insertion into an associated slot of the first plurality of slots of the first harbor; and a first plurality of grooves disposed between adjacent pairs of teeth of the first plurality of teeth, wherein each groove of the first plurality of grooves is aligned with an associated rib of the first plurality of ribs when the first connector is coupled to the first harbor; and a first connector bottom end protruding from the first harbor when the first connector is coupled to the first harbor, the first connector bottom end including a first angled strap slot; and a first strap inserted through the first angled strap slot.

2. The golf bag of claim 1, wherein an angle of the first angled strap slot is measured relative to a ground plane, when the first connector is coupled to the first harbor and the golf bag is at rest, in an upright position perpendicular to the ground plane, and a stand assembly of the golf bag is not deployed.

3. The golf bag of claim 1, wherein:

each slot of the first plurality of slots further comprises a recessed track; and each tooth of the first plurality of teeth further comprises a protrusion configured for insertion into an associated recessed track of the first plurality of slots.

4. The golf bag of claim 1, wherein:

the first harbor further defines a first aperture; and the first connector top end further comprises a first button deflectable between a first position, protruding from a portion of the first connector surrounding the first button, and a second position, flush with the portion of the first connector surrounding the first button.

5. The golf bag of claim 1, wherein:

the divider top further includes a second harbor, having:

a second plurality of ribs; and a second plurality of slots disposed between adjacent pairs of ribs of the second plurality of ribs.

6. The golf bag of claim 5, further comprising:

a second connector configured to be releasably coupled to the second harbor, the second connector including:

a second connector top end entirely received by the second harbor when the second connector is coupled to the second harbor, the second connector top end including:

a second plurality of teeth, wherein each tooth of the second plurality of teeth is sized for insertion into an associated slot of the second plurality of slots of the second harbor; and a second plurality of grooves disposed between adjacent pairs of teeth of the second plurality of teeth, wherein each groove of the second plurality of grooves is aligned with an associated rib of the second plurality of ribs when the second connector is coupled to the second harbor; and a second connector bottom end protruding from the second harbor when the second connector is coupled to the second harbor, the second connector bottom end including a second angled strap slot; and a second strap inserted through the second angled strap slot.

7. The golf bag of claim 6, wherein an angle of the second angled strap slot is measured relative to a ground plane, when the second connector is coupled to the second harbor and the golf bag is at rest, in an upright position perpendicular to the ground plane, and a stand assembly of the golf bag is not deployed.

8. The golf bag of claim 6, wherein the divider top further comprises a handle, and the first and second harbors are located adjacent opposite ends of the handle.

9. The golf bag of claim 8, wherein the first connector comprises a first button integrally formed with the first connector, wherein the first harbor defines a first button aperture; and wherein the first button aperture is configured to receive the first button.

10. The golf bag of claim 9, wherein the second connector comprises a second button integrally formed with the second connector, wherein the second harbor defines a second button aperture; and wherein the second button aperture is configured to receive the second button.

11. A golf bag, comprising:

a body;

a divider top coupled to the body, the divider top including:

a first harbor, having:

a first plurality of ribs;

a first plurality of slots disposed between adjacent pairs of ribs of the first plurality of ribs; and a first aperture;

a second harbor, having:

a second plurality of ribs;

a second plurality of slots disposed between adjacent pairs of ribs of the second plurality of ribs; and a second aperture;

a first connector configured to be releasably coupled to the first harbor, the first connector including:

a first connector top end entirely received by the first harbor when the first connector is coupled to the first harbor, the first connector top end including:

a first plurality of teeth, wherein each tooth of the first plurality of teeth is sized for insertion into an associated slot of the first plurality of slots of the first harbor;

a first plurality of grooves disposed between adjacent pairs of teeth of the first plurality of teeth, wherein each groove of the first plurality of grooves is aligned with an associated rib of the first plurality of ribs when the first connector is coupled to the first harbor; and a first button deflectable between a first position, protruding from a portion of the first connector surrounding the first button, and a second position, flush with the portion of the first connector surrounding the first button; and a first connector bottom end protruding from the first harbor when the first connector is coupled to the first harbor, the first connector bottom end including a first angled strap slot;

a second connector configured to be releasably coupled to the second harbor, the second connector including:

a second connector top end entirely received by the second harbor when the second connector is coupled to the second harbor, the second connector top end including:

a second plurality of teeth, wherein each tooth of the second plurality of teeth is sized for insertion into an associated slot of the second plurality of slots of the second harbor;

a second plurality of grooves disposed between adjacent pairs of teeth of the second plurality of teeth, wherein each groove of the second plurality of grooves is aligned with an associated rib of the second plurality of ribs when the second connector is coupled to the second harbor; and a second button deflectable between a first position, protruding from a portion of the second connector surrounding the second button, and a second position, flush with the portion of the second connector surrounding the second button; and a second connector bottom end protruding from the second harbor when the second connector is coupled to the second harbor, the second connector bottom end including a second angled strap slot;

a first strap inserted through the first angled strap slot; and a second strap inserted through the second angled strap slot.

12. The golf bag of claim 11, wherein an angle of the first angled strap slot is measured relative to a ground plane, when the first connector is coupled to the first harbor and the golf bag is at rest, in an upright position perpendicular to the ground plane, and a stand assembly of the golf bag is not deployed.

13. The golf bag of claim 12, wherein an angle of the second angled strap slot is measured relative to the ground plane, when the second connector is coupled to the second harbor and the golf bag is at rest, in the upright position perpendicular to the ground plane, and the stand assembly of the golf bag is not deployed.

14. The golf bag of claim 13, wherein the second angled strap slot has a smaller angle than the first angled strap slot.

15. The golf bag of claim 14, wherein a geometry of the first plurality of teeth of the first connector is different than a geometry of the second plurality of teeth of the second connector.

16. The golf bag of claim 15, wherein the divider top further comprises a handle, and the first and second harbors are located adjacent opposite ends of the handle.

* * * * *